US010838323B2

(12) United States Patent
Umeda et al.

(10) Patent No.: US 10,838,323 B2
(45) Date of Patent: Nov. 17, 2020

(54) IMAGE FORMING APPARATUS

(71) Applicant: CANON KABUSHIKI KAISHA, Tokyo (JP)

(72) Inventors: Kensuke Umeda, Kawasaki (JP); Shinsuke Kobayashi, Yokohama (JP); Takanori Watanabe, Kawasaki (JP); Ai Suzuki, Tokyo (JP); Kazuhiro Funatani, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/802,737

(22) Filed: Feb. 27, 2020

(65) Prior Publication Data

US 2020/0292966 A1 Sep. 17, 2020

(30) Foreign Application Priority Data

Mar. 15, 2019 (JP) ..... 2019-049203

(51) Int. Cl.
*G03G 15/08* (2006.01)

(52) U.S. Cl.
CPC ..... *G03G 15/0894* (2013.01); *G03G 15/0848* (2013.01); *G03G 15/0856* (2013.01)

(58) Field of Classification Search
CPC ..... G03G 15/0894; G03G 15/0856; G03G 15/0848; G03G 15/0822; G03G 15/0891; G03G 15/556
See application file for complete search history.

(56) References Cited

U.S. PATENT DOCUMENTS

2011/0091224 A1* 4/2011 Takenaka ..... G03G 15/5033 399/27
2011/0103810 A1* 5/2011 Yoshida ..... G03G 15/0844 399/27

FOREIGN PATENT DOCUMENTS

JP H08-30084 A 2/1996

* cited by examiner

*Primary Examiner* — Hoang X Ngo
(74) *Attorney, Agent, or Firm* — Venable LLP

(57) ABSTRACT

An image forming apparatus includes a notification portion configured to notify replenishment information for prompting replenishing a developing container with developer in a case where an index is equal to or larger than a preset threshold value. The index is set such that the index increases in accordance with rotation of the developer bearing member and decreases in accordance with replenishment of the developing container with the developer. An amount of increase of the index per predetermined amount of rotation of the developer bearing member is larger in a case where an amount of the developer in the developing container is smaller. An amount of decrease of the index according to the replenishment of the developing container with the developer is larger in a case where an amount of replenished developer is larger.

16 Claims, 15 Drawing Sheets

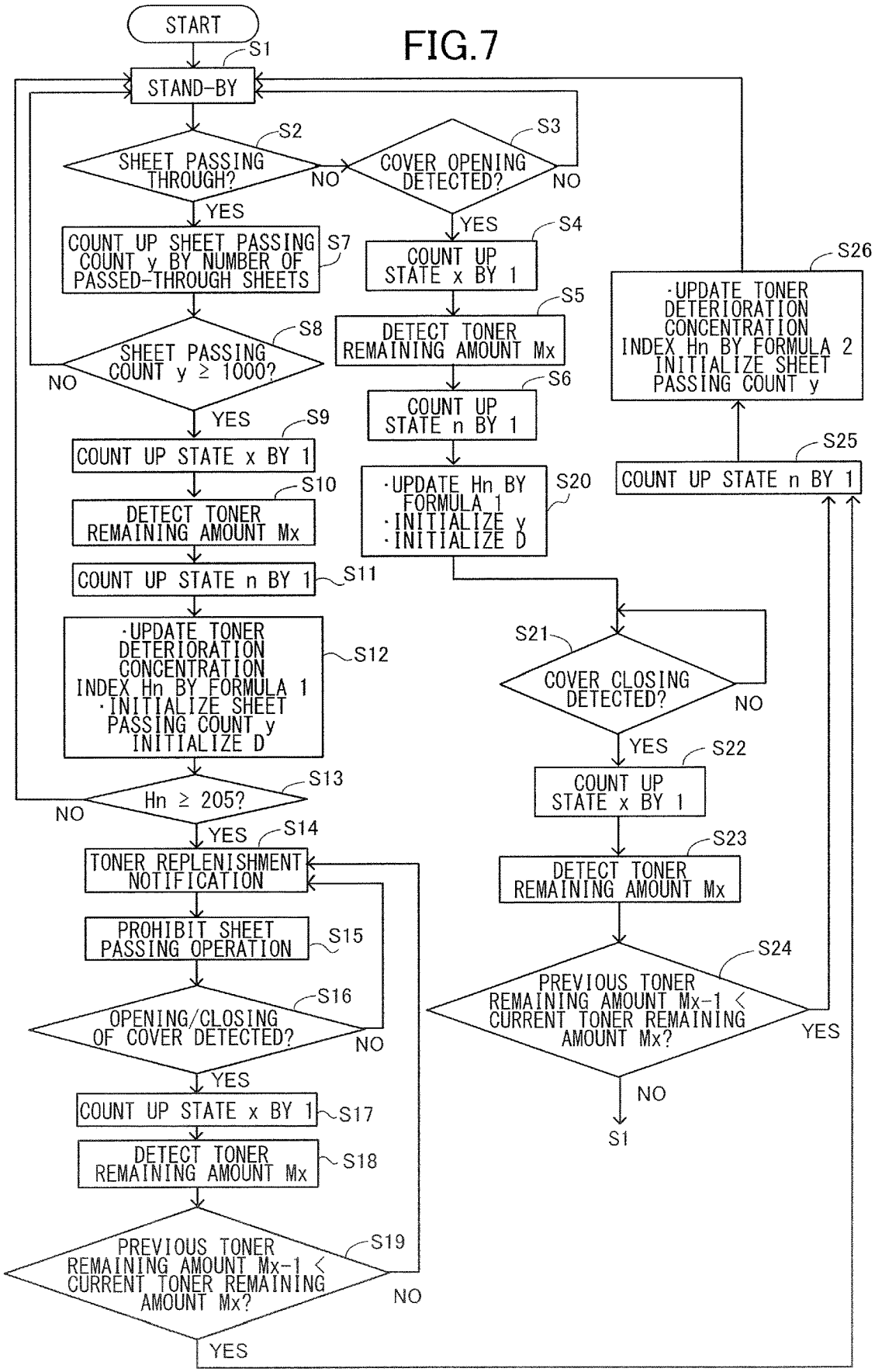
FIG.7
START
S1
STAND-BY
S2
SHEET PASSING THROUGH?
NO
YES
S3
COVER OPENING DETECTED?
NO
YES
S7
COUNT UP SHEET PASSING COUNT y BY NUMBER OF PASSED-THROUGH SHEETS
S4
COUNT UP STATE x BY 1
S5
DETECT TONER REMAINING AMOUNT Mx
S6
COUNT UP STATE n BY 1
S8
SHEET PASSING COUNT y ≥ 1000?
NO
YES
S9
COUNT UP STATE x BY 1
S10
DETECT TONER REMAINING AMOUNT Mx
S11
COUNT UP STATE n BY 1
S12
·UPDATE TONER DETERIORATION CONCENTRATION INDEX Hn BY FORMULA 1
·INITIALIZE SHEET PASSING COUNT y
INITIALIZE D
S13
Hn ≥ 205?
NO
YES
S14
TONER REPLENISHMENT NOTIFICATION
S15
PROHIBIT SHEET PASSING OPERATION
S16
OPENING/CLOSING OF COVER DETECTED?
NO
YES
S17
COUNT UP STATE x BY 1
S18
DETECT TONER REMAINING AMOUNT Mx
S19
PREVIOUS TONER REMAINING AMOUNT Mx-1 < CURRENT TONER REMAINING AMOUNT Mx?
NO
YES
S20
·UPDATE Hn BY FORMULA 1
·INITIALIZE y
·INITIALIZE D
S21
COVER CLOSING DETECTED?
NO
YES
S22
COUNT UP STATE x BY 1
S23
DETECT TONER REMAINING AMOUNT Mx
S24
PREVIOUS TONER REMAINING AMOUNT Mx-1 < CURRENT TONER REMAINING AMOUNT Mx?
YES
NO
S1
S25
COUNT UP STATE n BY 1
S26
·UPDATE TONER DETERIORATION CONCENTRATION INDEX Hn BY FORMULA 2
INITIALIZE SHEET PASSING COUNT y

FIG.9

| | CONDITION 1 | CONDITION 2 | CONDITION 3 | CONDITION 4 |
|---|---|---|---|---|
| REFERENCE EXAMPLE | Good | Bad | Bad | Bad |
| PRESENT EXEMPLARY EMBODIMENT (FIRST EXEMPLARY EMBODIMENT) | Good | Good | Good | Good |

| | CONDITION 5 | CONDITION 6 | CONDITION 7 |
|---|---|---|---|
| REFERENCE EXAMPLE | Good | Bad | Bad |
| PRESENT EXEMPLARY EMBODIMENT (SECOND EXEMPLARY EMBODIMENT) | Good | Good | Good |
| FIRST EXEMPLARY EMBODIMENT | Good | Good | Good |

IMAGE FORMING APPARATUS

BACKGROUND OF THE INVENTION

Field of the Invention

The present invention relates to an image forming apparatus configured to form an image on a recording material by using a toner.

Description of the Related Art

Generally, an image forming apparatus of an electrophotographic system forms an image by drawing an electrostatic latent image on the surface of an image bearing member such as a photosensitive drum, developing the electrostatic latent image by using toner, and transferring the developed toner image onto a recording material such as paper. Typically, a developing unit that performs development includes a developing container accommodating developer including toner, a developing roller that bears the developer, and a developing blade that regulates the amount of developer born on the developing roller.

Examples of a system of replenishing the developing unit with toner consumed for the development include a cartridge system in which the developing unit itself is replaced, and a toner replenishment system in which the developing unit is replenished with only the toner. In addition, examples of the toner replenishment system include a successive replenishment system in which a small amount of toner is successively supplied to the developing unit from a container such as a toner bottle, and a direct replenishment system in which a user directly supplies toner to the developing unit in the case where the amount of remaining toner in the developing unit has become small. Japanese Patent Laid-Open No. H8-30084 discloses a mechanism of a successive replenishment system in which a small amount of developer is successively supplied to a developing unit via a developer conveyance path from a developer supplying box. In contrast, a direct replenishment system is advantageous in terms of miniaturization of the image forming apparatus because the configuration of the image forming apparatus can be simplified. For example, according to the direct replenishment system, the developer conveyance path described in the document mentioned above is not required.

Incidentally, the toner in the developing container receives mechanical stress by being born on the developing roller and rubbed by a developing blade, a photosensitive drum, or the like, and gradually deteriorates. In a state in which the deterioration of the toner has progressed and the ratio of toner whose shape has been deformed from an original particle shape and toner whose external additives have peeled off from the surface of the particles has become large, there is a possibility that the behavior of the toner in development changes and an image defect occurs.

SUMMARY OF THE INVENTION

The present invention provides a mechanism for grasping transition of toner deterioration in a case where toner replenishment is performed.

According to one aspect of the invention, an image forming apparatus configured to form an image on a recording material, the image forming apparatus including: a rotatable image bearing member configured to bear an electrostatic latent image; a developing container configured to accommodate developer including toner; a developer bearing member configured to rotate while bearing the developer accommodated in the developing container and develop the electrostatic latent image born on the image bearing member into a toner image; a transfer member configured to transfer the toner image born on the image bearing member onto the recording material; and a notification portion configured to notify replenishment information for prompting replenishing the developing container with the developer in a case where an index is equal to or larger than a preset threshold value, wherein the index is set such that the index increases in accordance with rotation of the developer bearing member and decreases in accordance with replenishment of the developing container with the developer, wherein an amount of increase of the index per predetermined amount of rotation of the developer bearing member is larger in a case where an amount of the developer in the developing container is smaller, and wherein an amount of decrease of the index according to the replenishment of the developing container with the developer is larger in a case where an amount of replenished developer is larger.

According to another aspect of the invention, an image forming apparatus configured to form an image on a recording material, the image forming apparatus including: a rotatable image bearing member configured to bear an electrostatic latent image; a developing container configured to accommodate developer including toner; a developer bearing member configured to rotate while bearing the developer accommodated in the developing container and develop the electrostatic latent image born on the image bearing member into a toner image; a transfer member configured to transfer the toner image born on the image bearing member onto the recording material; and a notification portion configured to notify replenishment information for prompting replenishing the developing container with the developer, wherein the notification portion notifies the replenishment information if an amount of the developer in the developing container has decreased to a first value in a case of repetitively performing image formation on the recording material after the developing container is replenished with a first amount of the developer in a state in which a predetermined amount of the developer is accommodated in the developing container, and wherein the notification portion notifies the replenishment information if the amount of the developer in the developing container has decreased to a second value smaller than the first value in a case of repetitively performing image formation on the recording material after the developing container is replenished with a second amount of the developer in a state in which the predetermined amount of the developer is accommodated in the developing container, the second value being smaller than the first value.

Further features of the present invention will become apparent from the following description of exemplary embodiments with reference to the attached drawings.

BRIEF DESCRIPTION OF THE DRAWINGS

FIG. 7 is a flowchart illustrating a control method for the image forming apparatus according to the first exemplary embodiment.

FIG. 9 is a diagram showing results of an endurance test performed for the first exemplary embodiment.

DESCRIPTION OF THE EMBODIMENTS

Exemplary embodiments of the present invention will be described below with reference to drawings.

First Exemplary Embodiment

Figure 1A:
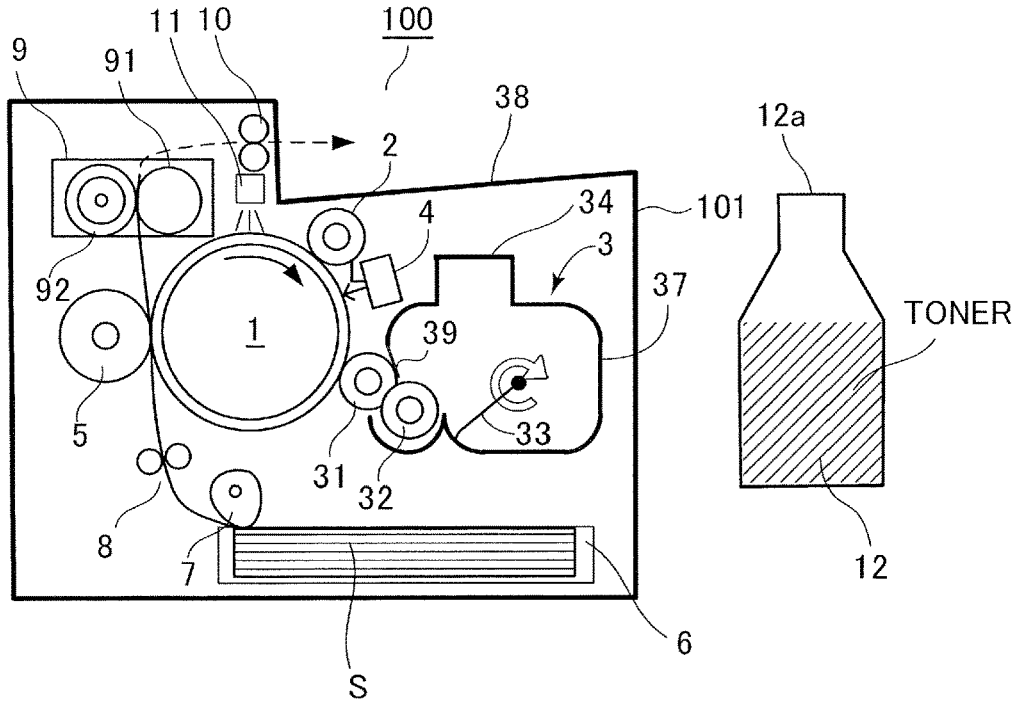
FIGS. 1A and 1B are each a schematic view of an image forming apparatus according to a first exemplary embodiment.

FIG. 1A is a schematic diagram illustrating a configuration of an image forming apparatus 100 according to a first exemplary embodiment. The image forming apparatus 100 is a monochromatic printer that forms an image on a recording material on the basis of image information input from an external apparatus. Examples of the recording material include sheets of different materials. Examples of the sheets of different materials include paper sheets such as regular paper sheets and cardboards, plastic films such as sheets for overhead projectors, sheets of irregular shapes such as envelops and index sheets, and cloths.

An apparatus body 101 of the image forming apparatus 100 includes an electrophotographic unit of a direct transfer system. That is, the apparatus body 101 includes a developing apparatus 3, a transfer roller 5, and a pre-exposing unit 11. The developing apparatus 3 includes a photosensitive drum 1, a charging roller 2 disposed in the vicinity of the photosensitive drum 1, an exposing unit 4, and a developing roller 31. The photosensitive drum 1 is an image bearing member of the present exemplary embodiment, the charging roller 2 is a charging member of the present exemplary embodiment, the exposing unit 4 is an exposing unit of the present exemplary embodiment, the developing roller 31 is a developing member of the present exemplary embodiment, and the transfer roller 5 is a transfer member of the present exemplary embodiment.

The photosensitive drum 1 is a photosensitive member formed in a cylindrical shape. The photosensitive drum 1 of the present exemplary embodiment includes a drum-shaped base body formed from aluminum, and a photosensitive layer formed from a negatively-chargeable organic photoconductor thereon. In addition, the photosensitive drum 1 is rotationally driven in a predetermined direction at a predetermined peripheral speed by a driving motor. In the present exemplary embodiment, the predetermined direction is a clockwise direction in FIGS. 1A and 1B. The peripheral speed of the photosensitive drum 1 defines the speed of image formation performed by the image forming apparatus 100, and is therefore also referred to as a process speed.

The charging roller 2 is in contact with the photosensitive drum 1 by a predetermined pressure contact force to form a charging portion. In addition, a desired charging voltage is applied to the charging roller 2 by a charging high-voltage power source, and thus the charging roller 2 uniformly charges the surface of the photosensitive drum 1 to a predetermined potential. In the present exemplary embodiment, the photosensitive drum 1 is negatively charged by the charging roller 2.

The exposing unit 4 of the present exemplary embodiment is a laser scanner unit. That is, the exposing unit 4 exposes the surface of the photosensitive drum 1 in a scanning manner by irradiating the photosensitive drum 1 with laser light corresponding to the image information input from the external apparatus by using a polygon mirror. As a result of this exposure, an electrostatic latent image corresponding to the image information is formed on the surface of the photosensitive drum 1. To be noted, the exposing unit 4 is not limited to a laser scanner unit, and for example, a light-emitting diode: LED exposing unit including an LED array in which a plurality of LEDs are arranged along the longitudinal direction of the photosensitive drum 1 may be employed.

The developing apparatus 3 includes a developing container 37 serving as a frame member of the developing apparatus 3, the developing roller 31 serving as a developer bearing member, and a supply roller 32 serving as a supply member that supplies developer to the developer bearing member. A developer accommodating chamber that accommodates toner serving as developer of the present exemplary embodiment is formed in the developing container 37. The developing roller 31 and the supply roller 32 are rotatably supported by the developing container 37. In addition, the developing roller 31 is disposed in an opening portion of the developing container 37 so as to oppose the photosensitive drum 1. The supply roller 32 is rotatably in contact with the developing roller 31, and the toner accommodated in the developing container 37 is applied on the surface of the developing roller 31 by the supply roller 32.

In the developing apparatus 3, a contact developing system is used as the developing system. That is, a toner layer born on the developing roller 31 comes into contact with the photosensitive drum 1 in a developing portion, that is, a developing region where the photosensitive drum 1 and the developing roller 31 face each other. A developing voltage is applied to the developing roller 31 by a developing high-voltage power source. The toner born on the developing roller 31 is transferred from the developing roller 31 onto the surface of the photosensitive drum 1 in accordance with the potential distribution of the surface of the photosensitive drum 1 under the developing voltage, and thus the electrostatic latent image is developed into a toner image. To be noted, in the present exemplary embodiment, a reversal development system is employed. That is, toner attaches to a surface region of the photosensitive drum 1 where the amount of charges is reduced by being exposed in an exposing step after being charged in a charging step, and thus a toner image is formed.

In the present exemplary embodiment, a regular toner having a particle diameter of 6 μm whose normal charging polarity is a negative polarity is used. For example, a polymer toner manufactured by a polymerization method is used as the toner of the present exemplary embodiment. In addition, the toner of the present exemplary embodiment is so-called nonmagnetic one-component developer that does not contain a magnetic component, and is born on the developing roller 31 mainly by an intermolecular force or an electrostatic force, in other words, an image force. However, a one-component developer containing a magnetic component may be used. In some cases, the one-component developer contains an additive for adjusting the fluidity or charging performance of the toner is contained in addition to the toner particles. Examples of the additive include wax and silica fine particles. In addition, a two-component developer constituted by nonmagnetic toner and magnetic carrier may be used as the developer. In the case of using a magnetic developer, for example, a tubular developing sleeve on an inner surface of which a magnet is disposed is used as a developer bearing member.

Figure 1B:
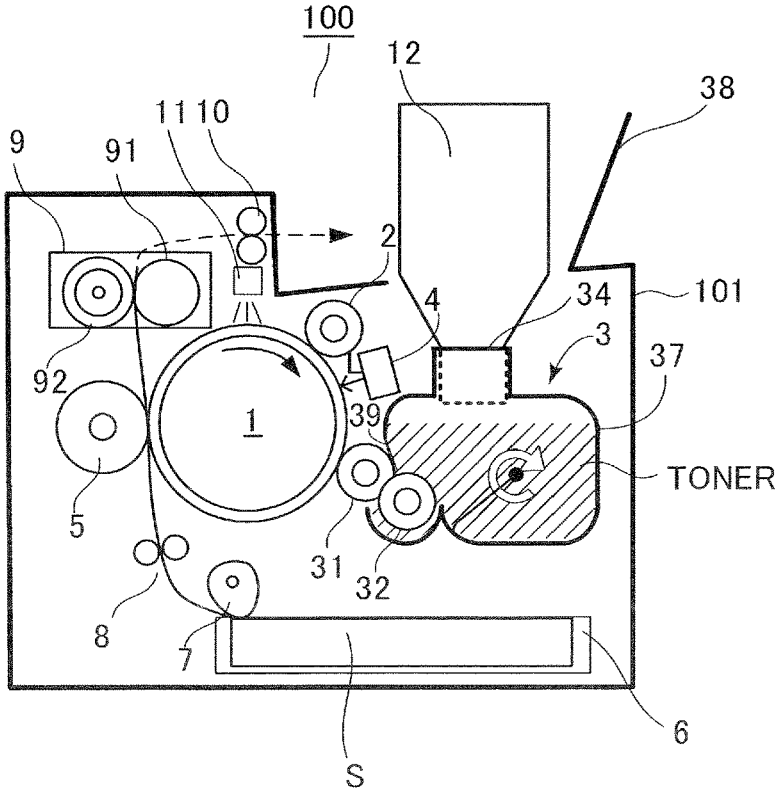

An agitation blade 33 serving as an agitation member is provided inside the developing container 37. The agitation blade 33 pivots to agitate the toner and deliver the toner to the developing roller 31 and the supply roller 32 by being driven by a driving motor. As illustrated in FIGS. 1A and 1B, the agitation blade 33 rotates in a clockwise direction in FIGS. 1A and 1B about a rotation shaft. In addition, the agitation blade 33 has a function of circulating, in the developing container 37, toner that has not been used for development and has been peeled off from the developing roller 31, and thus uniformizing the toner in the developing container 37.

In addition, a developing blade 39 serving as a regulation member that regulates the amount of developer born on the developer bearing member is disposed in the opening portion of the developing container 37 in which the developing roller 31 is disposed. The toner supplied to the surface of the developing roller 31 is uniformly flattened into a thin layer and is negatively charged by frictional charging, by passing through a portion where the developing roller 31 and the developing blade 39 face each other in accordance with the rotation of the developing roller 31.

In the present exemplary embodiment, the developing roller 31 is formed by forming a base layer of silicone rubber on a conductive core metal and a surface layer of urethane rubber thereon. To be noted, the volume resistivity of the developing roller 31 may be $10^4\Omega$ or higher and $10^{13}\Omega$ or lower. In addition, in the present exemplary embodiment, the developing blade 39 is an SUS (stainless steel) metal plate having a thickness of 0.1 mm.

To be noted, the amount of charges of the toner per unit weight by frictional charging can be increased by increasing the contact pressure between the developing roller 31 and the developing blade 39. This amount will be hereinafter referred to as a toner charge amount. By increasing the toner charge amount, a state in which the toner is likely to be transferred from the developing roller 31 onto the photosensitive drum 1 by the potential difference between an exposed portion of the photosensitive drum 1 and the developing roller 31 is realized. To be noted, in the case where the contact pressure is too high, the toner charge amount becomes too large in a low-temperature and low-humidity environment, and thus there is a possibility that the image density becomes low. In the case where the toner charge amount is too large, the potential difference between the exposed portion and an unexposed portion on the surface of the photosensitive drum 1 is filled up with only a small amount of toner, and thus the density of the developed toner image becomes insufficient. Therefore, the contact pressure, that is, pressurizing force per unit length in the longitudinal direction, of the developing blade 39 is preferably from 10 gf/cm to 100 gf/cm. In the present exemplary embodiment, the contact pressure between the developing roller 31 and the developing blade 39 is set to 30 gf/cm.

The transfer roller 5 may be preferably constituted by an elastic member such as a sponge rubber formed from polyurethane rubber, ethylene propylene diene monomer rubber: EPDM rubber, nitrile butadiene rubber: NBR, or the like. In the present exemplary embodiment, a nickel-plated steel rod having a diameter of 5 mm and covered by a foam sponge of NBR whose resistance is adjusted to $5\times10^7\Omega$ is used as the transfer roller 5. The resistance can be adjusted by mixing a conductive material such as hydrin or carbon in the NBR. The outer diameter of the foam sponge is 13 mm. The width of the foam sponge in a direction perpendicular to the conveyance direction of the recording material, that is, in the longitudinal direction of the transfer roller 5, is set to 216 mm, assuming a Letter size as the maximum size of a recording material on which an image can be formed by the image forming apparatus 100.

The transfer roller 5 is pressed against the photosensitive drum 1, and forms a transfer portion where the photosensitive drum 1 and the transfer roller 5 are in pressure contact. While conveyance deviation and transfer deviation become less likely to occur and higher image quality can be achieved in the case where the pressing force between the photosensitive drum 1 and the transfer roller 5 is higher, image defects derived from transfer omission becomes likely to occur in the case where the pressing force is too high. The pressing force between the photosensitive drum 1 and the transfer roller 5 is, for example, preferably 4.9 N to 24.5 N, that is, 500 gf to 2500 gf. In the present exemplary embodiment, the pressing force is set to 9.8 N, that is, 1000 gf. In addition, in the conveyance direction of the recording material, the width of a nip region where the photosensitive drum 1 and the transfer roller 5 are in contact with each other in the transfer portion is about 1 mm.

Recording materials S accommodated in a cassette 6 are fed one by one by a feeding unit 7 at a timing matching the toner image formed on the photosensitive drum 1 reaching the transfer portion, and the fed recording material S is conveyed to the transfer portion through a registration roller pair 8. In addition, a transfer voltage is applied from a transfer high-voltage power source to the transfer roller 5 at a timing when the toner image formed on the photosensitive drum 1 reaches the transfer portion. As a result of this, the toner image born on the photosensitive drum 1 is transferred onto the recording material passing through the transfer portion.

The recording material S onto which the toner image has been transferred is conveyed to a fixing unit 9. The fixing unit 9 is of a thermal fixation type that performs a process of fixing an image by heating and thus melting the toner on the recording material. The fixing unit 9 of the present exemplary embodiment includes a fixing film 91, a fixing heater such as a ceramic heater that heats the fixing film 91, a thermistor that measures the temperature of the fixing heater, and a pressurizing roller 92 that comes into pressure contact with the fixing film 91. The toner image is heated and pressurized when the recording material S passes through a nip portion between the fixing film 91 and the pressurizing roller 92. As a result of this, the toner particles melt and then adhere to the recording material S, and thus the image is fixed to the recording material S. The recording material S that has passed through the fixing unit 9 is discharged to the outside of the image forming apparatus 100 by a discharge roller pair 10. Examples of other heating mechanisms for heating a fixing member such as the fixing film 91 in a thermal fixation system include halogen lamps and induction heating systems.

In addition, the image forming apparatus 100 includes the pre-exposing unit 11 serving as a charge removing unit that performs charge removing processing on the photosensitive drum 1 and is provided downstream of the transfer portion and upstream of the charging portion in the rotation direction of the photosensitive drum 1. The pre-exposing unit 11 eliminates the surface potential of the photosensitive drum 1 at a position before entering the charging portion, to cause stable electrical discharge in the charging portion.

Figure 2:
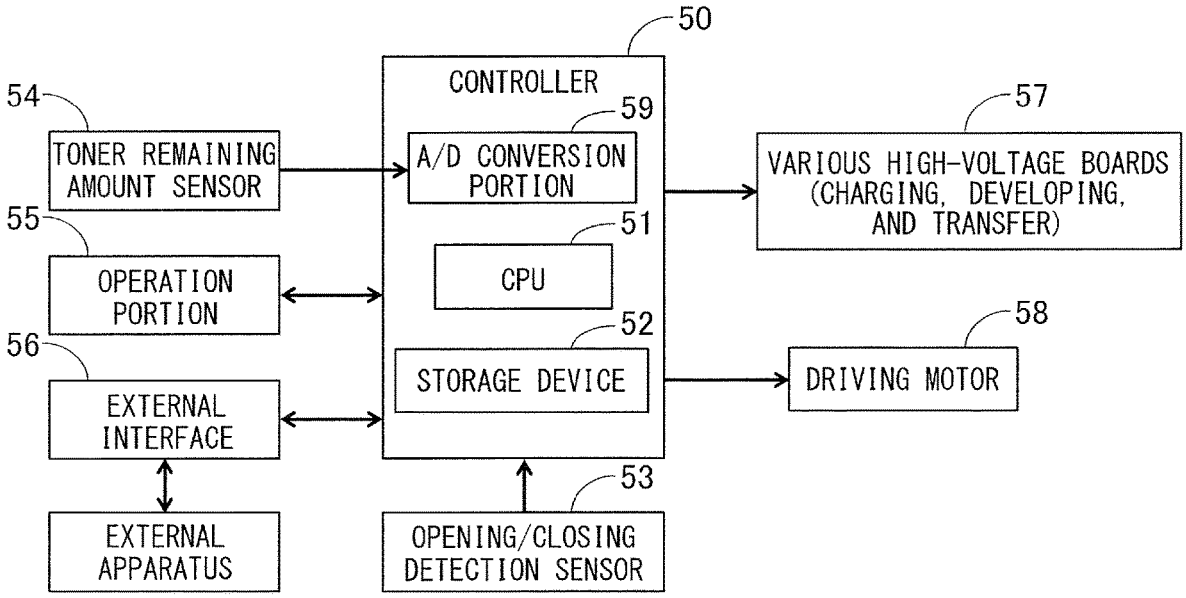
FIG. 2 is a block diagram illustrating a control configuration of the image forming apparatus according to the first exemplary embodiment.

FIG. 2 is a block diagram illustrating a control system of the image forming apparatus 100. The image forming apparatus 100 includes, as a controller that controls the operation of the apparatus, a controller 50 including a central processing unit: CPU 51, a storage device 52 including a nonvolatile storage area and a volatile storage area, and am analog/digital conversion portion: A/D conversion portion 59. The CPU 51 loads and executes a control program stored in the storage device 52, and thus operates various high-voltage boards, the driving motor 58, and so forth to perform the image forming operation described above. Examples of the various high-voltage boards include the charging high-voltage power source, the developing high-voltage power source, and the transfer high-voltage power source. To be noted, the driving motor 58 of the present exemplary embodiment is a shared drive source that drives at least the photosensitive drum 1, the developing roller 31, the supply roller 32, the agitation blade 33, and the feeding unit 7. In addition, the storage device 52 serves as an example of a non-transitory computer-readable storage medium storing a control program for causing the image forming apparatus 100 to perform a predetermined method.

The controller 50 is connected to an operation portion 55 serving as a user interface of the image forming apparatus 100. The operation portion 55 includes a display apparatus such as a liquid crystal panel, and an input device such as a mechanical key or a touch panel of the liquid crystal panel. The controller 50 conveys information to the user through the operation portion 55, and receives input of information, for example, setting of conditions such as image density, from the user. the information conveyed to the user through the operation portion 55 includes toner replenishment notification for prompting the user to replenish toner.

In addition, the controller 50 is electrically connected to a toner remaining amount sensor 54 and an opening/closing detection sensor 53, and receives signals output from these sensors. Particularly, an analog signal output from the toner remaining amount sensor 54 is digitalized by the A/D conversion portion 59 and analyzed by the CPU 51. The toner remaining amount sensor 54 and the opening/closing detection sensor 53 will be described later. In addition, the controller 50 is connected to an external apparatus through an external interface: external I/F 56, and is thus capable of mutually communicating data with the external apparatus. Examples of the external apparatus include a personal computer: PC in which driver software corresponding to the image forming apparatus 100 is installed, and in this case, the user can instruct execution of printing to the image forming apparatus 100 by an operation input through the screen of the PC.

Collection of Transfer Residual Toner

Transfer residual toner remaining on the photosensitive drum 1 without being transferred onto the recording material S is removed by the following procedure. The transfer residual toner contains positively charged toner and toner that is negatively charged but does not have enough charges. By removing charges on the photosensitive drum 1 by the pre-exposing unit 11 after transfer and causing uniform electrical discharge from the charging roller 2, the transfer residual toner is negatively charged again. The transfer residual toner negatively charged again at the charging portion reaches an exposing portion in accordance with the rotation of the photosensitive drum 1. Then, the surface region of the photosensitive drum 1 having passed through the charging portion is exposed by the exposing unit 4 in the state in which the transfer residual toner is still attached to the surface, and thus an electrostatic latent image is drawn in the surface region.

Here, description of behavior of the transfer residual toner that has reached the developing portion will be given for the exposed portion and the unexposed portion of the photosensitive drum 1, respectively. The transfer residual toner attached to the unexposed portion of the photosensitive drum 1 is transferred onto the developing roller 31 due to the potential difference between the potential of the unexposed portion of the photosensitive drum 1, that is, dark potential, and the developing voltage in the developing portion, and is collected into the developing container 37. This is because, assuming that the normal charging polarity of the toner is a negative polarity, the developing voltage applied to the developing roller 31 is relatively positive with respect to the potential of the exposed portion. To be noted, the toner collected into the developing container 37 is agitated with and dispersed in the toner in the developing container 37 by the agitation blade 33, and is born on the developing roller 31 to be used again in a developing step.

Meanwhile, the transfer residual toner attached to the exposed portion of the photosensitive drum 1 remains on the surface of the photosensitive drum 1 without being transferred from the photosensitive drum 1 onto the developing roller 31 in the developing portion. This is because, assuming that the normal charging polarity of the toner is a negative polarity, the developing voltage applied to the developing roller 31 is further negative with respect to the potential of the exposed portion, that is, light potential. The transfer residual toner remaining on the surface of the photosensitive drum 1 moves to the transfer portion by being born on the photosensitive drum 1 together with other toner transferred from the developing roller 31 to the exposed portion, and is thus transferred onto the recording material S in the transfer portion.

As described above, although a cleanerless configuration in which the transfer residual toner is collected into the developing apparatus 3 and reused is employed in the present exemplary embodiment, a conventionally known configuration in which the transfer residual toner is collected by using a cleaning blade abutting the photosensitive drum 1 may be employed. In this case, the transfer residual toner collected by the cleaning blade is collected into a collection container provided in addition to the developing apparatus 3. A control method for toner replenishment that will be described later is also applicable to such a configuration in which the transfer residual toner is not collected into the developing apparatus 3 to be reused. However, by employing the cleanerless configuration, a space for installing a collection container for collecting the transfer residual toner and the like does not have to be provided, which enables further miniaturization of the image forming apparatus 100, and the printing cost can be also reduced by reusing the transfer residual toner.

Supply of Developer to Developing Apparatus

Next, a method of replenishing the image forming apparatus 100 with developer will be described. In the present exemplary embodiment, a direct replenishment system in which the user repetitively supplies developer to the developing apparatus 3 from a container filled with developer for replenishment in a state in which the developing apparatus 3 is attached to the image forming apparatus 100 is employed.

As illustrated in FIG. 1A, an opening portion 34 for receiving toner from a toner bottle 12 serving as an example of a supply container is provided in the developing container 37. The opening portion 34 is configured such that a supply port 12*a* of the toner bottle 12 can be attached to and detached from the opening portion 34. In a state in which a cover 38 provided on an upper surface of the apparatus body 101 is closed, the opening portion 34 is covered by the cover 38. Although the cover 38 serving as an opening/closing member is pivotable with respect to the apparatus body 101 about a hinge provided in an end portion on the right side in FIG. 1A, for example, an opening/closing member of a sliding type may be used, or a double door in which a hinge is provided on each of opposing sides of the opening may be used.

As illustrated in FIG. 1B, when the cover 38 is opened, the opening portion 34 is exposed, and it becomes possible to attach the toner bottle 12 to the developing apparatus 3 from above. When the toner bottle 12 is attached and the supply port 12*a* and the opening portion 34 are connected, toner in the toner bottle 12 falls due to its own weight and moves to the developing container 37. As a result of this, toner is supplied from the toner bottle 12 to the developing apparatus 3. By placing a connecting portion between the supply port 12*a* of the toner bottle 12 and the opening portion 34 of the developing apparatus 3 inside the apparatus body 101, scattering of toner to the surroundings of the image forming apparatus 100 when replenishing toner by the direct replenishment system can be reduced.

Figure 5A:
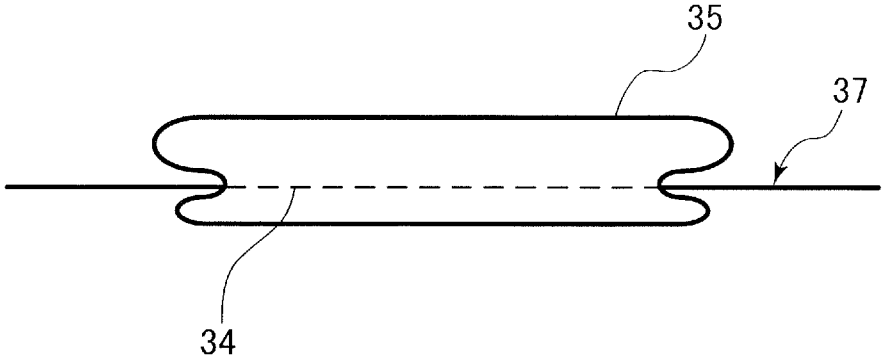
FIGS. 5A to 5C are diagrams illustrating a cap attached to the developing apparatus and the toner bottle according to the first exemplary embodiment.
Figure 5B:
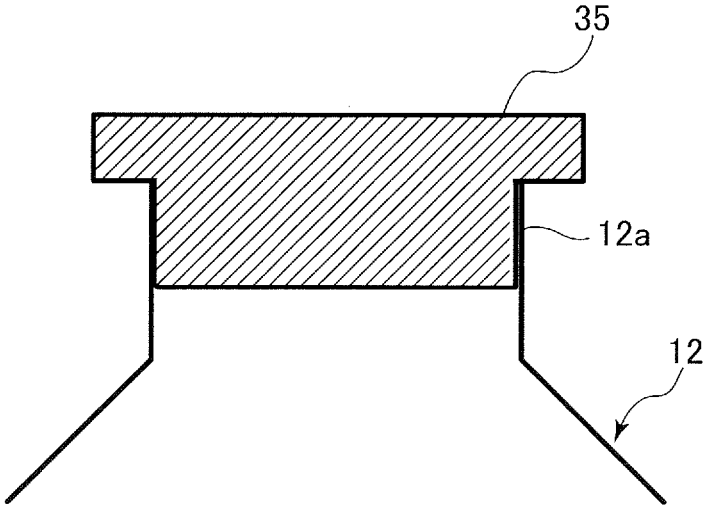
Figure 5C:
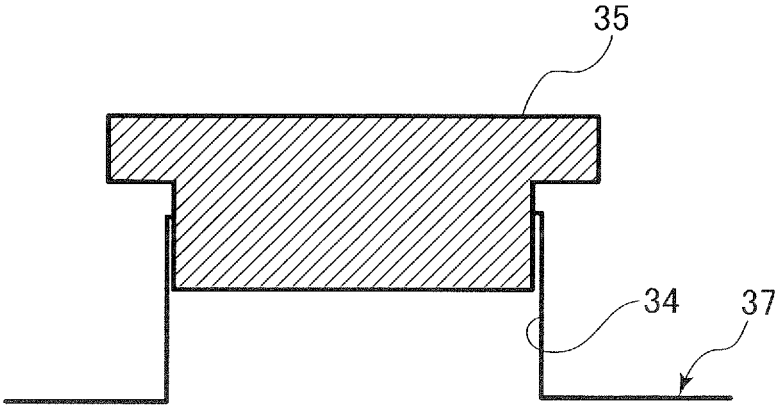

Then, when the opening/closing detection sensor 53 illustrated in FIG. 2 detects that the cover 38 is closed, it becomes possible to start driving the agitation blade 33 and the developing roller 31, and the toner remaining amount is detected as will be described later. After the toner bottle 12 is detached from the image forming apparatus 100 after replenishing toner, a cap 35 illustrated in FIGS. 5A to 5C is attached to the supply port 12*a* of the toner bottle 12 and the opening portion 34 of the developing apparatus 3. As a result of this, leakage of toner from the developing apparatus 3 during image formation and from the toner bottle 12 detached from the image forming apparatus 100 can be prevented.

The image forming apparatus 100 has a function of, in the case where the developing apparatus 3 needs to be replenished with toner, notifying information prompting the user to perform toner replenishment and stopping the image forming operation. In this case, as illustrated in FIG. 1A, it is preferable that the agitation blade 33 is stopped in an inclined state such that the toner falling from above is guided to the developing roller 31 and the supply roller 32 by the agitation blade 33. In this manner, by using the agitation blade 33 as a toner guiding member, toner can be supplied to the developing roller 31 more quickly.

To be noted, employing a successive replenishment system in which a toner bottle is mounted in the image forming apparatus 100 and toner supplied from the toner bottle is supplied to the developing apparatus 3 little by little by a hopper apparatus instead of the direct replenishment system can be also considered. A hopper apparatus is an apparatus that temporarily reserves the toner discharged from the toner bottle 12 and supplies the toner to the inside of the developing apparatus 3 by using a toner conveyance member such as a screw.

However, in the successive replenishment system, a space serving as a conveyance path for the toner from the toner bottle to the developing apparatus 3 and a drive source and a drive transmission mechanism for driving the toner conveyance member are required, which leads to increase in the size of the apparatus. In addition, in the successive replenishment system, a waiting time in which the image forming apparatus 100 cannot output an image may occur after replacing the toner bottle due to a delay until toner supplied from the replaced toner bottle actually reaches the developing apparatus 3. The direct replenishment system of the present exemplary embodiment has an advantage that the apparatus can be further miniaturized because the conveyance path for the toner is not needed, and the delay until the image forming apparatus 100 resumes image output after the operation of replenishing toner can be shortened.

In addition, as illustrated in FIGS. 1A and 1B, the toner bottle 12 is attachable to and detachable from the image forming apparatus 100, and the image forming operation is performed in a state in which the toner bottle 12 is detached. By employing such a configuration, a space for keeping the toner bottle 12 in the image forming apparatus 100 is not needed, and thus it is possible to further miniaturize the image forming apparatus 100.

Figure 15A:
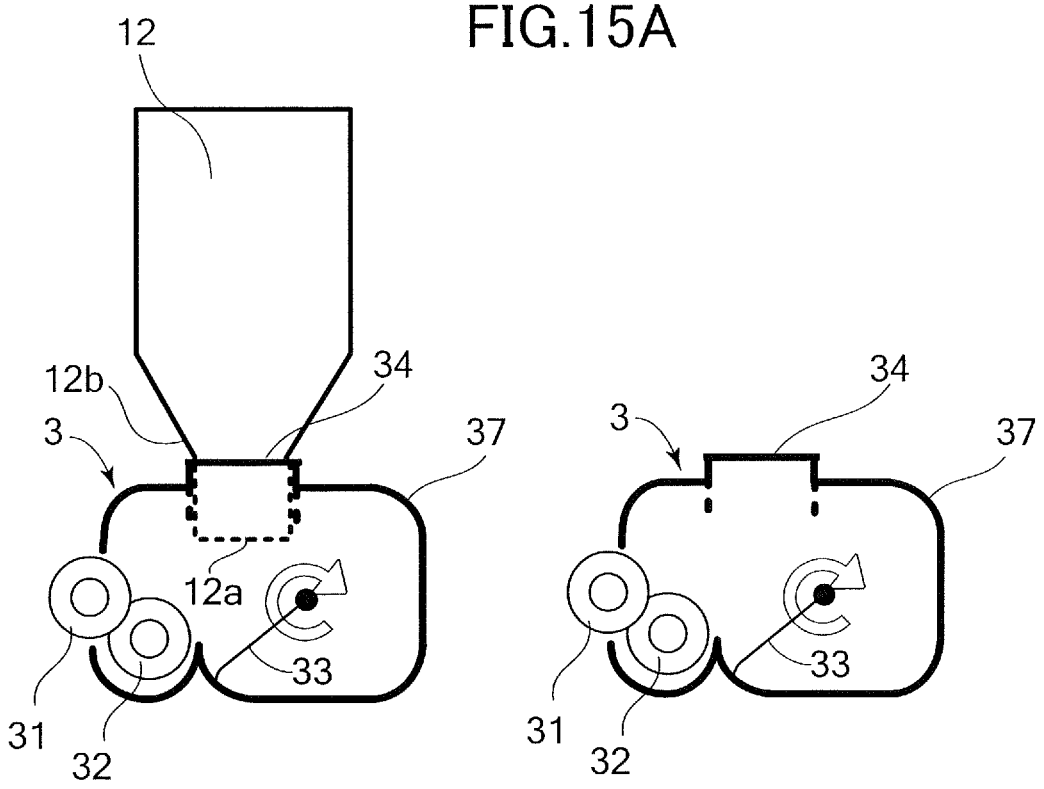
FIGS. 15A and 15B are diagrams illustrating modification examples of the shapes of developing apparatus and toner bottle.

To be noted, the shapes of the supply port 12*a* of the toner bottle 12 and the opening portion 34 of the developing apparatus 3 are not limited to the shapes illustrated in FIGS. 1A and 1B as long as the supply port 12*a* can be connected to and detached from the opening portion 34. For example, in FIG. 15A, the opening portion 34 projects upward from the upper surface of the developing container 37. In addition, the inner wall of the opening portion 34 extends below the upper surface of the developing container 37 toward the inside of the developing container 37. This is indicated by a dotted line on the right side of FIG. 15A. The toner bottle 12 is guided downward as a result of the outer wall of the supply port 12*a* coming into contact with the inner wall of the opening portion 34, and downward movement of the toner bottle 12 is restricted by a result of a bottle side surface 12*b* whose outer diameter is larger than that of the supply port 12*a* coming into contact with the edge of the opening portion 34.

Figure 15B:
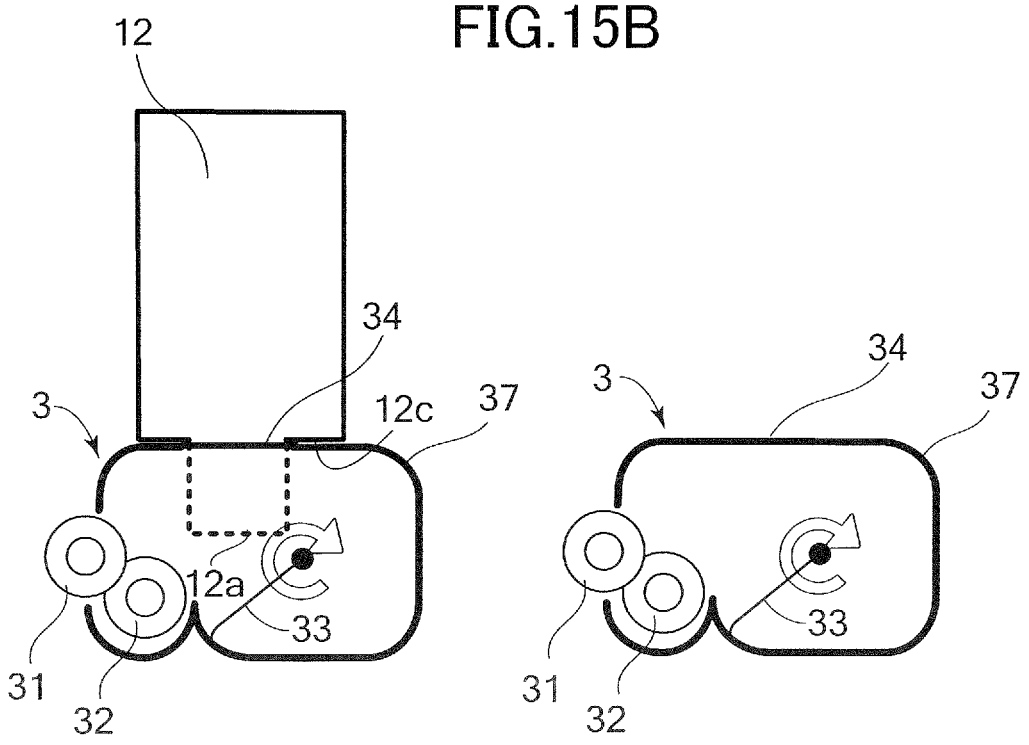

In addition, as illustrated in FIG. 15B, the toner bottle 12 may have an abutting surface 12*c* that abuts the developing container 37, and the downward movement of the toner bottle 12 may be restricted by the abutting surface 12*c* abutting the upper surface of the developing container 37.

Accommodated Developer Amount of Toner Bottle

The amount of toner accommodated in the toner bottle 12 will be described. Although the amount of toner accommodated in the toner bottle 12 may be appropriately selected, in the present exemplary embodiment, the amount of toner accommodated in the toner bottle 12 is preferably from A g to B g. Here, A g is such a toner amount that the toner is accommodated in a region below a horizontal plane including the highest point of the developing roller 31 in the vertical direction in the inner space of the developing container 37 in an orientation of the developing apparatus 3 during image formation. That is, A g is the minimum amount of toner with which the developing roller 31 is covered by replenished toner in the case where toner replenishment is performed in a state in which the developing container 37 is empty.

In addition, B g is a difference between the maximum amount of toner that can be accommodated in the developing container 37 and the toner remaining amount at which the toner replenishment notification is performed. Therefore, in the case where the amount of toner accommodated in the toner bottle 12 is set to a value of A g to B g, all toner accommodated in the toner bottle 12 can be moved to the developing container 37 when the user performs the toner replenishment operation in accordance with the toner replenishment notification.

Figure 4:
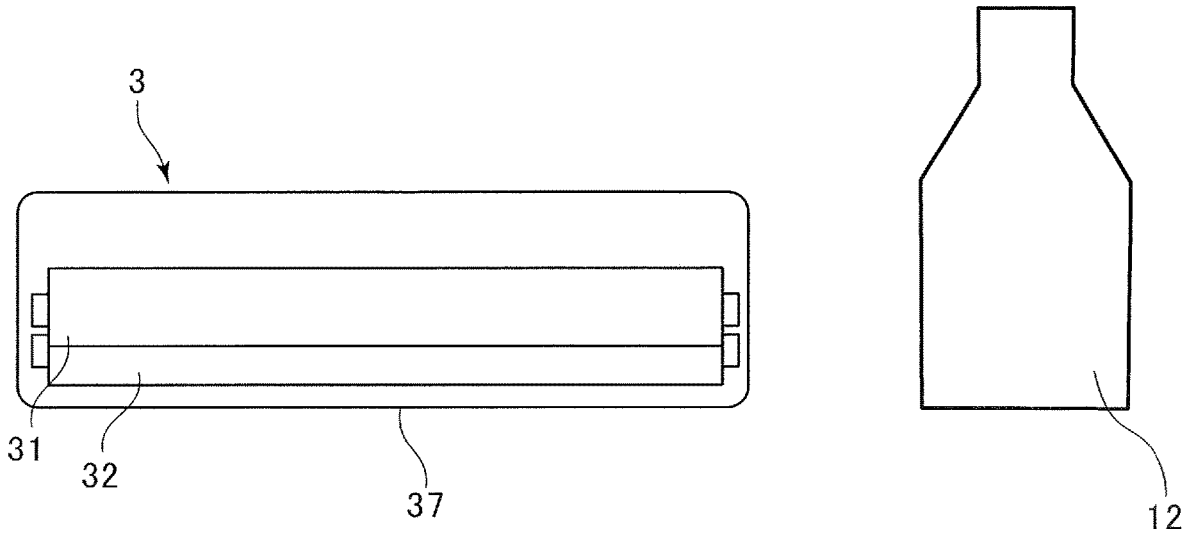
FIG. 4 is a diagram for comparing a developing apparatus and a toner bottle according to the first exemplary embodiment.

FIG. 4 illustrates a relationship between the developing apparatus 3 and the toner bottle 12 as viewed in a direction perpendicular to the longitudinal direction of the developing roller 31. As illustrated, the developing container 37 extends in the longitudinal direction, and has a capacity large enough to receive all toner sealed in the toner bottle 12.

Method for Detecting Toner Remaining Amount

Next, a method for detecting the toner remaining amount in the developing apparatus 3 will be described with reference to FIGS. 3A to 3C. To be noted, the toner remaining amount detected herein does not have to be the weight of the toner itself remaining in the developing apparatus 3. The toner remaining amount may be information indicating the weight of the toner or a signal indicating a state that changes in accordance with the toner remaining amount as long as the information can be used by the CPU 51. The developing apparatus 3 of the present exemplary embodiment includes the toner remaining amount sensor 54 of an optical type as a detection portion for detecting the amount of developer remaining in the developing container. The remaining amount information detected by the toner remaining amount sensor 54 can be also referred to as a signal indicating a state that changes in accordance with the toner remaining amount.

The toner remaining amount sensor 54 is constituted by a light emitting portion 22 and a light receiving portion 23 disposed in the developing container 37. The light emitting portion 22 emits light toward the light receiving portion 23 via an optical path R passing through the inside of the developing container 37. The light receiving portion 23 outputs a signal on the basis of whether or not light from the light emitting portion 22 is detected.

When the agitation blade 33 rotates, toner struck up by the agitation blade 33 blocks the optical path R, and thus the signal output from the light receiving portion 23 changes. FIG. 3A illustrates a state in which the optical path R is not blocked by the toner, and the light receiving portion 23 detects the light from the light emitting portion 22 in this state.

Figure 3A:
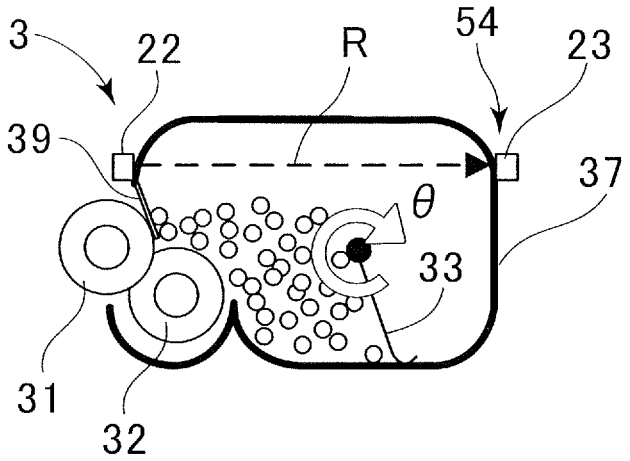
FIGS. 3A to 3C are diagrams for describing a toner remaining amount sensor in the first exemplary embodiment.
Figure 3B:
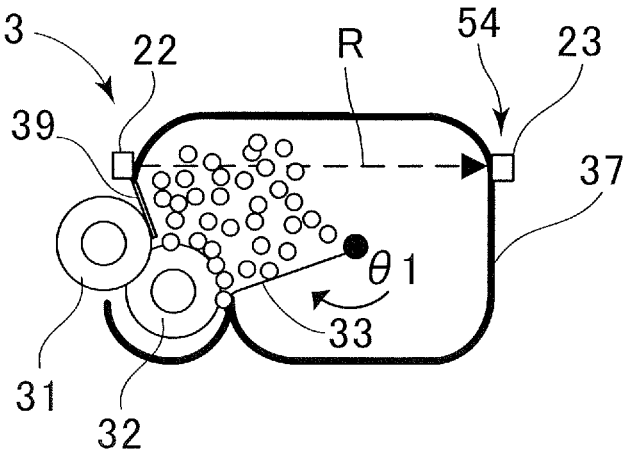

FIG. 3B illustrates a state in which the agitation blade 33 has rotated by an angle 61 from the state illustrated in FIG. 3A. The agitation blade 33 presses the toner in the developing container 37 toward the developing roller 31 and pushes up the toner toward an upper portion of the developing container 37. In this state, the optical path R is blocked by part of the toner, and thus the light receiving portion 23 does not detect the light from the light emitting portion 22.

Figure 3C:
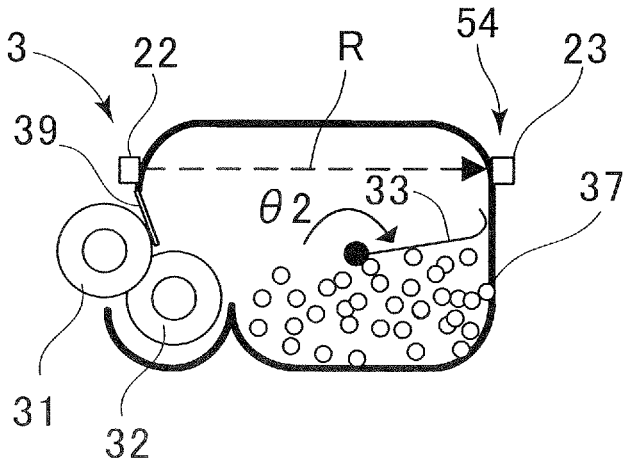

FIG. 3C illustrates a state in which the agitation blade 33 has rotated by an angle 62 from the state illustrated in FIG. 3B. Since the toner has fallen to the bottom portion of the developing container 37 due to its own weight and the optical path R is not blocked by the toner or the agitation blade 33, the light receiving portion 23 detects the light from the light emitting portion 22. In the case where the agitation blade 33 further rotates in an arrow O direction in this state, the state transitions to the state illustrated in FIG. 3A.

In this manner, a period in which the light receiving portion 23 does not detect the light from the light emitting portion 22 and a period in which the light receiving portion 23 detects the light are included in one rotation of the agitation blade 33. In addition, even in the case where the light receiving portion 23 detects the light, the received light intensity changes depending on the situation. The length of the period in which the light receiving portion 23 detects the light from the light emitting portion 22, that is, light transmission time, and the intensity of the light received by the light receiving portion 23, that is, the light amount, change depending on the amount of toner remaining in the developing container 37. That is, in the case where the toner remaining amount is large, the optical path R is easily blocked by the toner, and therefore the light transmission time is short and the intensity of the received light is low. Conversely, in the case where the toner remaining amount is small, the light transmission time is long and the intensity of the received light is high. Therefore, the CPU 51 detects the toner remaining amount in the developing apparatus 3 as, for example, a value in a range of 0% to 100% by setting the maximum amount of toner that can be accommodated in the developing container 37 as 100%, by obtaining the signal output from the toner remaining amount sensor 54 through the A/D conversion portion 59 and analyzing the change in the light transmission time, the received light intensity, and the change in the received light intensity. Specifically, the CPU 51 specifies the toner remaining amount by referring to a table in which toner remaining amount information is assigned to each light transmission time and each received light intensity.

To be noted, the method for detecting/estimating the toner remaining amount is not limited to the method described with reference to FIGS. 3A to 3C, and various known methods for detecting/estimating the toner remaining amount can be employed. For example, the toner remaining amount may be detected/estimated by disposing two or more metal plates or conductive resin sheets extending in the longitudinal direction of the developing roller 31 on the inner wall of the developing container 37 serving as the frame member and measuring the capacitance between two metal plates or conductive resin sheets. Alternatively, a load cell may be provided to support the developing apparatus 3 from below, and the CPU 51 may calculate the toner remaining amount by subtracting the weight of the developing apparatus 3 including no toner from the weight measured by the load cell.

Toner Replenishment Notification

When the amount of developer remaining in the developing container 37 becomes small, the image forming apparatus 100 performs toner replenishment notification of notifying the user of information prompting toner replenishment, that is, replenishment information. The controller 50 having the function of performing the toner replenishment notification serves as a notification portion of the present exemplary embodiment. For example, as a method for notification, a message indicating that the toner needs to be replenished may be displayed on a display apparatus such as a liquid crystal display. In addition, the notification may be performed by using a sound through a loudspeaker, or may be performed by lighting or flickering a light emitting diode lamp: LED lamp. The toner replenishment notification may be performed by using the operation portion 55 provided in the image forming apparatus 100 as a medium for toner replenishment notification, or may be performed by using an external apparatus illustrated in FIG. 2 connected to the image forming apparatus 100 via the external I/F 56 as a medium for toner replenishment notification, by transmitting data to the external apparatus. Examples of the external apparatus include a personal computer. In addition, the communication with the external apparatus via the external I/F 56 may be performed wirelessly or in a wired manner.

Maintenance of Operation Stopped State

The image forming apparatus 100 includes the opening/closing detection sensor 53 illustrated in FIG. 2 that detects a state in which the cover 38 is open. As the opening/closing detection sensor 53, an optical sensor or a mechanical sensor can be used. In the case where a signal indicating the state in which the cover 38 is open is input from the opening/closing detection sensor 53, the controller 50 does not allow the image forming apparatus 100 to perform the image forming operation. That is, the controller 50 does not allow driving the photosensitive drum 1 and so forth to form an image on a recording material even in the case where a print job is input from the outside. In addition, the attachment state of the toner bottle 12 may be detected instead of detecting the state in which the cover 38 is open. That is, in the case where it is detected by an unillustrated sensor that the toner bottle 12 is attached to the opening portion 34, the controller 50 similarly does not allow the image forming operation.

As described above, the configuration described in the present exemplary embodiment enables providing a mechanism with which toner replenishment of higher usability can be performed. Specifically, for example, after toner replenishment is performed, image formation can be resumed quickly, and the downtime can be reduced. In addition, for example, the size of the image forming apparatus can be reduced because a complex toner conveyance path or the like is not needed, and thus the cost can be reduced. Further, for example, problems such as toner scattering that are likely to occur in an image forming apparatus of a toner replenishment type can be prevented.

Deterioration of Toner

Figure 6:
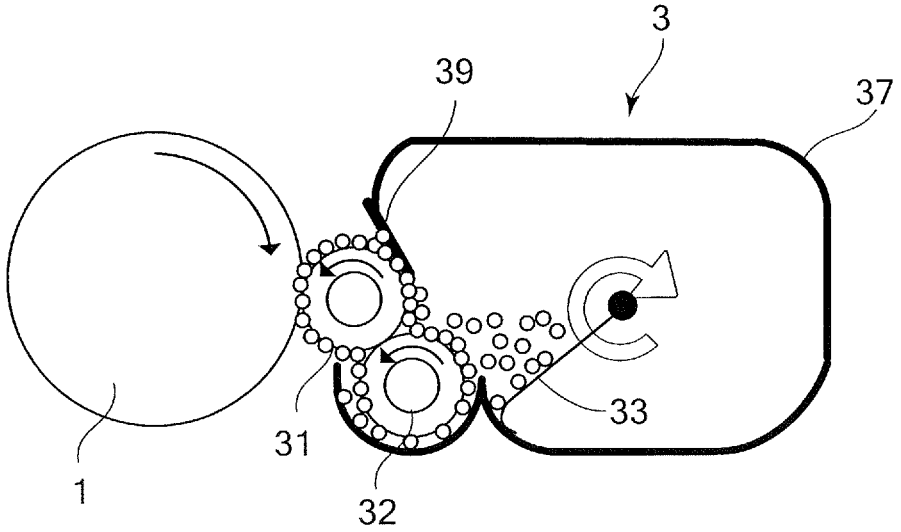
FIG. 6 is a schematic view of the developing apparatus according to the first exemplary embodiment.

Next, a mechanism of progress of deterioration of the toner in the developing container will be described. As illustrated in FIG. 6, the developing roller 31 and the supply roller 32 rotate in arrow directions. The developing roller 31 rotates at a peripheral speed of 100% with respect to the photosensitive drum 1, and the supply roller 32 rotates in a counter direction at a peripheral speed of 80% with respect to the developing roller 31. The toner in the developing container 37 is delivered to the supply roller 32 by the agitation blade 33, and is delivered to the developing roller 31 from the supply roller 32. The amount of toner born on the developing roller 31 is regulated to a predetermined toner amount by the developing blade 39 in accordance with the rotation of the developing roller 31, that is, the thickness of toner layer is regulated to a predetermined value, and the toner is rubbed by the developing blade 39 to be charged by triboelectrification.

Part of toner that has reached the developing portion where the developing roller 31 and the photosensitive drum 1 face each other moves to the region in the surface of the photosensitive drum 1 where the electrostatic latent image has been formed, that is, the exposed portion in the present exemplary embodiment. The toner remaining on the developing roller 31 without moving to the photosensitive drum 1 is peeled off from the developing roller 31 by the supply roller 32. In addition, the transfer residual toner that has moved from the photosensitive drum 1 onto the developing roller 31 in the developing portion is also peeled off from the developing roller 31 by the supply roller 32. As described above, while the developing roller 31 is rotating, a process of supplying part of the toner in the developing container to the developing roller 31 and then peeling off the toner that has not been used for the development from the developing roller 31 is repeated.

Here, the toner born on the developing roller 31 receives mechanical stress by being rubbed by the developing blade 39 and the photosensitive drum 1, and thus phenomena such as detachment of external additives on the surface of the toner particles and deformation of the toner particles occur. When these phenomena become prominent, the toner becomes less likely to be negatively charged when rubbed by the developing blade 39, and thus the toner charge amount becomes insufficient.

The state in which the toner charge amount is insufficient is a state in which the toner particles born on the developing roller 31 include relatively many particles having a charge amount close to 0 or having charges of a polarity opposite to the normal charging polarity. Such toner attaches to a region where the electrostatic latent image is not formed in the surface of the photosensitive drum 1 and is transferred onto the recording material from the photosensitive drum 1, and thus a thin toner image is attached to a region in the recording material where an image is not supposed to be formed. Such an image defect is referred to as "background fogging".

The speed of progress of deterioration of the toner in the developing container 37 depends on the toner remaining amount in the developing container 37 at each time point. This is because, as described above, the main cause of the deterioration of toner is the mechanical stress that the toner receives by being born on the developing roller 31 and rubbed by the developing blade 39 and the photosensitive drum 1. Focusing on one toner particle circulating in the developing container 37, the frequency at which this toner particle is born on the developing roller 31 is lower in the case where the toner remaining amount in the developing container is larger. Therefore, in a state in which the toner remaining amount in the developing container 37 is large, the progress of deterioration of toner is slow. In contrast, in the case where the toner remaining amount in the developing container 37 is small, the frequency at which the one toner particle is born on the developing roller 31 is high, and thus the progress of deterioration of toner is fast.

Here, when an image forming operation is performed, part of toner agitated and uniformized in the developing container 37 is used for development of the electrostatic latent image on the photosensitive drum 1 and then transferred onto the recording material, and thus the toner in the developing container 37 is consumed. Therefore, it can be considered that the degree of deterioration of toner consumed for image formation on the recording material and the degree of deterioration of the toner accommodated in the developing container at the same time point are approximately the same.

Toner Deterioration Concentration Index

In the present exemplary embodiment, in order to reduce image defects caused by the deterioration of toner, whether or not the developing container needs to be replenished with toner is determined by using a toner deterioration concentration index $H_n$, which is an index indicating the degree of deterioration of the toner in the developing container.

The toner deterioration concentration index $H_n$ indicates the degree of deterioration of the toner particles included in the toner in the developing container as an average. Specifically, the toner deterioration concentration index $H_n$ is a value corresponding to the accumulated counts of being born on the developing roller 31 and reaching the developing portion of respective toner particles, and is defined as an average value for all toner particles accommodated in the developing container. In other words, in a case where one toner particle is randomly extracted from toner particles in the developing container, the toner deterioration concentration index $H_n$ is an index associated with the expectation of the accumulated count of being born on the developing roller 31 and reaching the developing portion of the toner particle after being supplied into the developing container.

As described above, the progress speed of deterioration of toner in the developing container according to the rotation of the developing roller 31 depends on the toner remaining amount in the developing container at each time point. In addition, when new toner is supplied into the developing container, the degree of deterioration of toner in the developing container in average is improved. Therefore, in the present exemplary embodiment, the toner deterioration concentration index $H_n$ is defined by a recurrence formula that changes in accordance with the increase in the accumulated rotation amount of the developing roller 31 and changes also in the case where the developing container is replenished with toner.

Hereinafter, a state n is used as a variant indicating the accumulated rotation amount of the developing roller 31. The value of n, which is an integer, is set to 0 at the start of use of the image forming apparatus, and is then counted up in accordance with the increase in the accumulated rotation amount of the developing roller 31. In the present exemplary embodiment, the toner deterioration concentration index $H_n$ is calculated each time the accumulated number of sheets of the recording material on which images have been formed, that is, the number of passed-through sheets, increases by 1000. To be noted, although the toner deterioration concentration index $H_n$ is updated in accordance with the number of passed-through sheets in the present exemplary embodiment, the toner deterioration concentration index $H_n$ may be updated on the basis of a different value as long as the value increases in accordance with the increase in the number of passed-through sheets. For example, the number of rotations of the driving motor 58 illustrated in FIG. 2 that drives the developing roller 31 may be recorded, and the toner deterioration concentration index $H_n$ may be updated each time the accumulated rotation amount of the developing roller 31 increases by a predetermined number of rotations. For example, in the case where the state n is counted up each time the number of passed-through sheets increases by 1000, the accumulated rotation amount corresponding to the number of passed-through sheets of 1000 is set as the predetermined number of rotations described above.

In the present exemplary embodiment, the change in the toner deterioration concentration index $H_n$ according to the increase in the accumulated rotation amount of the developing roller 31 is expressed as follows. In actuality, the CPU 51 reads out the accumulated rotation amount of the developing roller 31 and a program from the storage device 52, and performs calculation using the following formula (1). The same applies to the formula (2) that will be described later.

$$H_n = H_{n-1} + K \times D / (M_x + M_{x-1})/2 \quad (1)$$

Here, $M_x$ is the toner remaining amount in the developing container in a state x. $M_x$ stores the toner remaining information detected by the mechanism described with reference to FIG. 3. In addition, the state x is an integer, is set to 0 at the start of use of the image forming apparatus, and is then counted up like from M1 to M2 at a timing before detection each time the toner remaining amount is detected. That is, the state x indicates the number of times the toner remaining amount in the developing container is detected. For example, in the case where the toner remaining amount is detected each time the number of passed-through sheets increases by 1000, the state x is counted up each time the number of passed-through sheets increases by 1000. At which frequency x is counted up may be appropriately set each time in accordance with the circumstances.

D represents increase in the accumulated rotation amount of the developing roller 31 in the case where, for example, image formation is performed on 1000 sheets of the recording material. In actuality, the CPU 51 manages a rotation amount increment D from a reference timing of the developing roller 31 measured by a recording unit that will be described later, and the value of D is initialized in predetermined steps, that is, S12, S20, and S26. K represents the amount of toner that reaches the developing portion in a state of being born on the developing roller 31 while the developing roller 31 rotates once.

In the present exemplary embodiment, the outer diameter of the developing roller 31 is 11.35 mm, the width of the developing roller 31 in the longitudinal direction is 221.8 mm, the rotational speed, that is, the peripheral speed of the developing roller 31 during image formation is 167.8 mm/sec, and the amount of toner born on the developing roller 31 in a state after passing by the developing blade 39 is 0.35 mg/cm$^2$. For example, the increment D of the accumulated rotation amount of the developing roller 31 in the case where image formation is performed on 1000 sheets of the recording material at a predetermined sheet interval is set to 27000 rotations. In this case, the value of K×D in the case where image formation is performed on 1000 sheets of the recording material is 750000 mg, that is, 750 g, in the formula (1). In actuality, the accumulated rotation amount of the developing roller 31 is recorded by the controller 50 in real time, and is stored in the storage device 52 in an appropriately referable form. In addition, as the toner remaining amount $M_x$ in the developing container in the state x, the detection result of the toner remaining amount sensor 54 described above can be used. To be noted, the unit of $M_x$ in the formula (1) is not limited to g, and any value corresponding to the actual toner remaining amount can be appropriately employed. The unit is not particularly limited. However, in this case, the value of K also needs to be corrected in accordance with the value corresponding to the toner remaining amount employed as $M_x$.

As described above, the toner deterioration concentration index $H_n$ increases in accordance with the rotation of the developing roller, and is set such that the amount of increase when the developing roller rotates by a predetermined amount is larger in the case where the amount of developer in the developing container is smaller.

Particularly, according to the formula (1), the toner deterioration concentration index $H_n$ is set such that the amount of increase thereof when the developing roller rotates by a predetermined amount is inversely proportional to the amount of developer in the developing container. As a result of this, the value of the toner deterioration concentration index $H_n$ more accurately reflects the toner deterioration based on the behavior of the toner in the image forming operation.

In addition, in the case where the developing container 37 is replenished with toner, it can be assumed that the toner that has been accommodated in the developing container 37 since before the toner replenishment and the toner newly charged into the developing container 37 by the toner replenishment are agitated and uniformly mixed by the agitation blade 33. That is, the toner that is accommodated in the developing container in a state immediately before the toner replenishment and has deteriorated to a certain extent is diluted by the toner newly supplied to the developing container 37 that has not deteriorated.

Therefore, the value of the toner deterioration concentration index $H_n$ after the replenishment can be expressed by the following formula, assuming that the value of the toner deterioration concentration index $H_n$ after the replenishment is reduced with respect to the value of $H_{n-1}$ immediately before the replenishment is performed, in accordance with the ratio of the toner remaining amount between before and after the replenishment.

$$H_n = H_{n-1} \times M_{x-1} / M_x \quad (2)$$

To be noted, $H_{n-1}$ represents the toner deterioration concentration index before the replenishment, $M_{x-1}$ represents the toner remaining amount before the replenishment, and $M_x$ represents the toner remaining amount after the replenishment. To be noted, in the case where the developing roller 31 has rotated for image formation since the timing at which the toner deterioration concentration index $H_{n-1}$ before the replenishment is updated, the controller 50 updates $H_{n-1}$ by using the formula (1) before updating $H_n$ by using the formula (2). That is, the controller 50 applies the toner remaining amount $M_{n-1}$ at the timing when $H_{n-1}$ is previously updated, the current toner remaining amount, and the number of rotations of the developing roller since the timing when the $H_{n-1}$ is previously updated to the formula (1), and thus updates the toner deterioration concentration index $H_{n-1}$. Then, the controller 50 applies the updated toner deterioration concentration index $H_{n-1}$ to the formula (2), and thus calculates the latest toner deterioration concentration index $H_n$.

The toner deterioration concentration index $H_n$ decreases when the developing container is replenished with the developer, and is set such that the amount of decrease when the developer is replenished is larger in the case where the amount of replenished developer is larger.

Particularly, according to the formula (2), the toner deterioration concentration index $H_n$ decreases in accordance with the ratio between the amount of developer in the developing container in the state before the replenishment and the amount of developer in the developing container in the state after the replenishment. As a result of this, the value of the toner deterioration concentration index $H_n$ more accurately reflects the degree of deterioration of the toner in average when the toner replenishment is performed.

The controller 50 of the present exemplary embodiment illustrated in FIG. 2 is provided with a recording unit that records the accumulated rotation amount of the developing roller 31, and the recording unit always records the change in the accumulated rotation amount of the developing roller 31 after setting the accumulated rotation amount to 0 at the start of use of the image forming apparatus. This recording unit obtains the increase in the accumulated rotation amount of the developing roller 31 by obtaining, for example, an output signal of a rotary encoder that detects the rotation amount of an output shaft of the driving motor 58. In addition, this recording unit may be implemented as a module of a control program executed by the CPU 51, or may be implemented by mounting a dedicated integrated circuit on the same circuit as the CPU 51.

As described above, in the present exemplary embodiment, the transition of toner deterioration in the case where toner replenishment is performed can be grasped. In addition, by prompting the user to perform toner replenishment in the case where the toner deterioration concentration index $H_n$ defined as described above exceeds a predetermined threshold value set in advance, background fogging caused by toner deterioration can be suppressed. A control method for the image forming apparatus using the toner deterioration concentration index $H_n$ will be described.

FIG. 7 is a flowchart illustrating the control method for the image forming apparatus in the present exemplary embodiment. Each step of this process is executed by the CPU 51 of the controller 50 illustrated in FIG. 2 reading and executing a control program stored in the storage device 52. In addition, this process is continuously performed in a state in which the main power of the image forming apparatus is on.

Steps S1 to S6 and S20 to S26

When the main power of the image forming apparatus is turned on, the CPU 51 takes a stand-by state in step S. In the stand-by state whether or not a series of operations for feeding a recording material and forming an image are performed is determined in step S2. Hereinafter, the series of operations will be referred to as a sheet passing operation. In a state in which the sheet passing operation is not performed, the user can replenish the developing container 37 with toner any time by opening the cover 38 of the image forming apparatus. Therefore, in the case where the sheet passing operation is not being performed, whether or not an opening/closing operation of the cover 38 is performed is determined from a detection result of the opening/closing detection sensor 53 in step S3. In the case where opening/closing of the cover 38 is not performed, it is determined that toner replenishment is not performed, and the process returns to step S1. In the stand-by state, normally, this loop from step S1 to step S3 is repeated.

In the case where it is determined in step S3 that the cover 38 is opened, that is, in the case where the result of step S3 is YES, it is determined that there is a possibility that the developing container 37 is replenished with toner. First, the state x is counted up in step S4, and the value of the toner remaining amount detected by the toner remaining amount sensor 54 is recorded as a toner remaining amount $M_x$ of this time in step S5. In this case, the toner remaining amount before opening/closing of the cover 38 is performed is at least temporarily held by the storage device 52 as a previous toner remaining amount $M_{x-1}$.

Next, the state n is counted up in step S6, and in step S20, the toner deterioration concentration index $H_n$ in the state immediately before the toner replenishment is calculated in accordance with the formula (1) described above and is stored in the storage device 52, the value of a sheet passing count y is initialized, and D is also initialized. Then, whether or not the cover 38 is closed is detected in step S21, and in the case where it is detected that the cover 38 is closed, the process proceeds to step S22.

In the case where the result of step S21 is YES, a process for checking the increase/decrease of the toner remaining amount by detecting the toner remaining amount in the developing container is performed. Specifically, when the cover 38 is opened, the driving motor 58 is driven to rotate the agitation blade 33 such that detection by the toner remaining amount sensor 54 is enabled. Then, the CPU 51 counts up the state x by 1 in step S22, and detects the toner remaining amount $M_x$ in step S23. As a result of this, the latest toner remaining amount $M_x$ after replenishment is obtained by the CPU 51.

Next, the previous toner remaining amount $M_{x-1}$ and the current toner remaining amount $M_x$, that is, the toner remaining amount after the toner replenishment, are compared in step S24, and in the case where $M_x$ is equal to or smaller than $M_{x-1}$, it is determined that toner replenishment is not performed, the process returns to step S1, and the stand-by state is taken. In the case where $M_x$ is larger than $M_{x-1}$, it is determined that toner replenishment has been performed by the user, and a process for updating the toner deterioration concentration index $H_n$ is performed.

Specifically, the state n is counted up in step S25, the toner deterioration concentration index $H_n$ in the state after the toner replenishment is calculated in accordance with the formula (2) described above and is stored in the storage device 52, and the value of the sheet passing count y is initialized in step S26, and the process returns to step S1. To be noted, the sheet passing count y is a variant managed by the CPU 51 to update the toner deterioration concentration index $H_n$ in accordance with the accumulated rotation amount of the developing roller 31. The sheet passing count y becomes 0 at the start of use of the image forming apparatus or when being initialized after the start of use, and is counted up by one each time one sheet passing operation is performed. To be noted, whereas the numbers of count-ups of the state x and the state n coincide with each other in the case where determination of NO has never been made in S24, the numbers of count-ups of the state x and the state n do not coincide with each other in the case where determination of NO has been made at least once in S24.

Steps S7 to S14

In the case where the sheet passing operation is performed in step S2, the sheet passing count y is counted up by the number of passed-through sheets in step S7. In the case where the sheet passing count y is smaller than 1000 sheets, it is determined in step S8 that the toner deterioration concentration index $H_n$ does not need to be updated, and the process returns to step S1.

In the case where the sheet passing count y is equal to or larger than 1000 sheets in step S8, a process for updating the toner deterioration concentration index $H_n$ is performed. Specifically, the state x is counted up in step S9, and the value of the toner remaining amount detected by the toner remaining amount sensor 54 is recorded as the current toner remaining amount $M_x$ in step S10. At this time, the toner remaining amount $M_x$ detected by the CPU 51 represents the toner remaining amount after toner replenishment in which toner is replenished with respect to $M_{x-1}$. Therefore, the CPU 51 can also calculate the amount of replenished toner by subtracting $M_{x-1}$ from $M_x$. In addition, the state n is counted up in step S11, and in step S12, the toner deterioration concentration index $H_n$ is calculated in accordance with the formula (1) described above and is stored in the storage device 52, the value of the sheet passing count y is initialized, and D is initialized. As a result of this step S12 and step S20 described above, the CPU 51 can grasp the transition of toner deterioration in the case where toner replenishment is performed. The processing of toner replenishment notification of step S14 that will be described below is an application made on the premise that the transition of the toner deterioration in the case where toner replenishment is performed can be grasped.

In the case where the value of the toner deterioration concentration index $H_n$ updated in step S12 is smaller than 205, it is determined in step S13 that there is no need to perform toner replenishment notification for the user, and the process returns to step S1. In contrast, in the case where the value of the toner deterioration concentration index $H_n$ updated in step S12 is equal to or larger than a threshold value, which is 205 in this case, it is determined in step S13 that toner replenishment notification needs to be performed, and the toner replenishment notification is performed in step S14 by any one of the notification methods described above.

Steps S15 to S19, S25, and S26

In the case of performing toner replenishment notification, new sheet passing operation is prohibited in step S15, and a waiting state is taken until toner replenishment is performed. In the waiting state, whether or not opening/closing operation of the cover 38 is performed is determined in step S16 from the detection result of the opening/closing detection sensor 53, and in the case where opening/closing of the cover 38 is not performed, it is determined that toner replenishment is not performed, and the waiting state is continued. In the case where it is detected in step S16 that opening/closing of the cover 38 is performed, it is determined that there is a possibility that the developing container 37 is replenished with toner. In this case, a process of detecting the toner remaining amount in the developing container 37 and confirming increase/decrease in the toner remaining amount is performed in steps S17 to S19 by the same method as in steps S22 to S24.

The previous toner remaining amount $M_{x-1}$ and the current toner remaining amount $M_x$ are compared in step S19, and in the case where $M_x$ is equal to or smaller than $M_{x-1}$, it is determined that toner replenishment is not performed, and the process returns to step S14. In this case, neither of the prohibition of the toner replenishment notification and the prohibition of the sheet passing operation is cancelled. In the case where $M_x$ is larger than $M_{x-1}$, it is determined that toner replenishment by the user is performed, the processing of steps S25 and S26 described above is performed to update the toner deterioration concentration index $H_n$, the value of the sheet passing count y is initialized, D is initialized, and then the process returns to step S1.

As described above, according to the present exemplary embodiment, in the case where the toner deterioration concentration index $H_n$ indicating the degree of deterioration of toner in the developing container in average is equal to or larger than a preset threshold value, which is 205 in this case, the image forming apparatus notifies the user of notification information for prompting toner replenishment in step S14. Therefore, occurrence of background fogging can be suppressed by prompting the user to perform toner replenishment before prominent background fogging is caused by toner deterioration.

To be noted, in the case of the image forming apparatus of the present exemplary embodiment, prominent background fogging recognized as an image defect occurs when the value of the toner deterioration concentration index $H_n$ exceeds 205 and reaches 230. That is, in the case where the toner deterioration concentration index $H_n$ exceeds 230, due to toner deterioration, toner supplied to the developing roller 31 cannot be sufficiently charged even when being rubbed by the developing blade 39. In the present exemplary embodiment, whether or not to perform toner replenishment notification is determined by using a threshold value smaller than such a limit value, and therefore occurrence of background fogging can be more reliably reduced.

Example of Transition of Toner Deterioration Concentration Index

Figure 8:
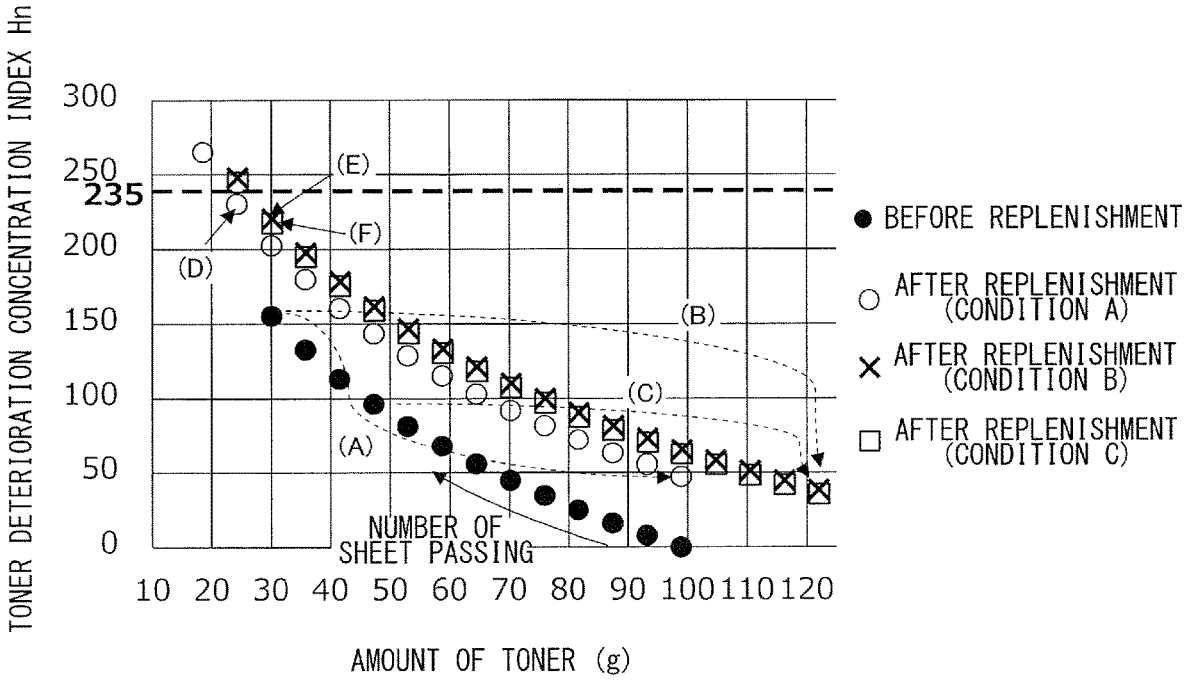
FIG. 8 is a diagram for describing difference in transition of a toner deterioration concentration index caused by difference in conditions of toner replenishment.

How the toner deterioration concentration index $H_n$ changes will be described with reference to specific examples. FIG. 8 illustrates results of study on influence of timing of toner replenishment on the toner deterioration concentration index $H_n$ in an image forming apparatus in which 99 g of toner is accommodated in the developing container at the start of use. That is, at the start of use of the image forming apparatus, the toner remaining amount is 99 g, and the toner deterioration concentration index $H_n$ is 0, which corresponds to the lowermost black circle on the right in FIG. 8.

In the case where the sheet passing operation is repetitively performed from the state of the start of use, the toner remaining amount gradually decreases, and the toner deterioration concentration index $H_n$ gradually increases. This can be seen by tracking black circles to the upper left side in FIG. 8. In this case, the sheet passing operation is performed in conditions in which the image coverage is 2%, and it is assumed that about 5.7 g of toner is consumed in the case where the sheet passing operation is performed on 1000 sheets of recording material. In addition, the toner deterioration concentration index $H_n$ is updated each time the sheet passing operation is performed on 1000 sheets.

Here, the transition of the toner deterioration concentration index $H_n$ after performing toner replenishment in three conditions that differ in the toner remaining amount at the time of toner replenishment and in the amount of replenished toner will be described.

(A) Toner is replenished when the toner remaining amount has decreased to 30 g such that the toner remaining amount reaches 99 g.

(B) Toner is replenished when the toner remaining amount has decreased to 30 g such that the toner remaining amount reaches 122 g.

(C) Toner is replenished when the toner remaining amount has decreased to 53 g such that the toner remaining amount reaches 122 g.

In the case where the sheet passing operation was repetitively performed after the toner is replenished in the condition (A), the toner deterioration concentration index exceeded 205 and the toner replenishment notification was performed when the toner remaining amount decreased to 24 g (D). In this case, the state of toner immediately after the toner replenishment, that is, the toner remaining amount and the value of the toner deterioration concentration index $H_n$ are indicated by the lowermost white circle on the right in FIG. 8. In contrast, in the case where the sheet passing operation was repetitively performed after replenishing toner in the condition (B) or (C), the toner deterioration concentration index exceeded 205 and the toner replenishment notification was performed when the toner remaining amount decreased to 30 g (E and F). In this case, the state of toner immediately after the toner replenishment is indicated by the lowermost cross on the right in FIG. 8 in the case of the condition (B), and is indicated by the lowermost square on the right in FIG. 8 in the case of the condition (C). As described above, the toner replenishment notification prompting the next toner replenishment was performed in accordance with the toner remaining amount and the amount of toner replenishment at the time when the previous toner replenishment was performed. As a result of this, the user can be prompted to perform toner replenishment before the value of the toner deterioration concentration index $H_n$ exceeds 235, and occurrence of background fogging can be suppressed.

Comparing the conditions (A) and (B) in which the toner remaining amount at which the previous toner replenishment was performed was the same, the next toner replenishment notification was performed in a state in which the toner remaining amount was larger in the case of the condition (B) in which the amount of replenished toner was larger.

In other words, in the case (B) of repetitively performing image formation on the recording material after the developing container is replenished with a first amount of developer in a state in which a predetermined amount of developer is accommodated in the developing container, (E) the replenishment information is notified by the notification portion when the amount of developer in the developing container decreases to a first value. In this case, the predetermined amount is 30 g, the first amount is 122-30=92 g, and the first value is 30 g. In contrast, in the case (A) of repetitively performing image formation on the recording material after the developing container is replenished with a second amount of developer smaller than the first amount in the state in which the predetermined amount of developer is accommodated in the developing container, (D) the replenishment information is notified by the notification portion when the amount of developer in the developing container decreases to a second value smaller than the first value. In this case, the second amount is 99-30=69 g, and the second value is 24 g.

In addition, Comparing the conditions (A) and (C) in which the toner remaining amount at which previous toner replenishment was performed was the same, the next toner replenishment notification was performed in a state in which the toner remaining amount was larger in the case of the condition (C) in which the toner remaining amount at the time of toner replenishment was larger. As described above, in the present exemplary embodiment, the toner replenishment notification is performed on the basis of the toner deterioration concentration index $H_n$ dependent on the toner remaining amount and the amount of replenished toner at the time of the previous toner replenishment instead of simply performing toner replenishment notification only on the basis of the toner remaining amount.

Evaluation Test for Image Quality

To evaluate whether occurrence of background fogging can be actually suppressed by the configuration of the present exemplary embodiment, an endurance test was performed as follows. An image forming apparatus to which the configuration of the present exemplary embodiment was applied was caused to repetitively perform the sheet passing operation, and whether or not background fogging occurred was evaluated. As a recording material, Xerox Vitality Multipurpose Paper (Letter size, 20 lb) was used.

As a reference example, an image forming apparatus that always performs toner replenishment notification when the toner remaining amount in the developing container becomes smaller than a certain threshold value, which is 30 g in this case, was prepared. In contrast, as described above, the toner replenishment notification is performed in the case where the toner deterioration concentration index $H_n$ exceeds 205 in the present exemplary embodiment. The toner deterioration concentration index $H_n$ was calculated each time the sheet passing operation was performed 1000 times. The toner remaining amount was based on the detection result of the toner remaining amount sensor 54. In addition, in both of the reference example and the present exemplary embodiment, about 5.7 g of toner was consumed when an image of image coverage of 2% was formed on 1000 sheets of the recording material, and about 2.9 g of toner was consumed when an image of image coverage of 1% was formed on 1000 sheets of the recording material.

The endurance test was conducted in the following four conditions.

Condition 1: The sheet passing operation was performed at an image coverage of 2% until toner replenishment notification was performed after toner was replenished such that the toner remaining amount became 99 g. This was repetitively performed three times.

Condition 2: The sheet passing operation was performed at an image coverage of 2% until toner replenishment notification was performed after toner was replenished such that the toner remaining amount became 122 g. This was repetitively performed three times.

Condition 3: After the toner was replenished such that the toner remaining amount became 99 g, the sheet passing operation was performed at an image coverage of 2% until the toner remaining amount reached 64.4 g. This was repetitively performed four times, then the toner was replenished such that the toner remaining amount became 99 g, and the sheet passing operation was performed at an image coverage of 2% until toner replenishment notification was performed.

Condition 4: The sheet passing operation was performed at an image coverage of 1% until toner replenishment notification was performed after toner was replenished such that the toner remaining amount became 99 g. This was repetitively performed three times.

The results of the evaluation are shown in FIG. 9. Images output during the test were evaluated. "Good" corresponds to images non-problematic for practical use, and "Bad" corresponds to occurrence of background fogging problematic for practical use.

In the reference example, no problem occurred in Condition 1, but background fogging problematic for practical use occurred in Condition 2 in which the amount of replenished toner was larger than in Condition 1, in Condition 3 in which the timing of toner replenishment was earlier than in Condition 1, and in Condition 4 in which the image coverage was lower than in Condition 1. This is because, even in a state in which the toner remaining amount is the same, the degree of toner deterioration varies depending on conditions such as the toner remaining amount and amount of replenished toner at the time of previous toner replenishment, and the amount of toner consumption per one sheet of recording material. In the configuration of the reference example, the toner replenishment notification is performed when the toner remaining amount becomes below a certain threshold value, regardless of the degree of deterioration of the toner in the developing container. Therefore, it can be considered that background fogging derived from toner deterioration occurred in the case where the toner remaining amount in the developing container was larger than the threshold value and the degree of deterioration of the toner in the developing container was equal to or higher than a certain degree.

In contrast, in the present exemplary embodiment, it was confirmed that occurrence of background fogging derived from toner deterioration was reduced. This is a result of monitoring the degree of deterioration of the toner in the developing container in average by using the toner deterioration concentration index $H_n$ and performing the toner replenishment notification to prompt the user to perform toner replenishment such that the toner deterioration concentration index $H_n$ does not exceed 235.

Figure 10A:
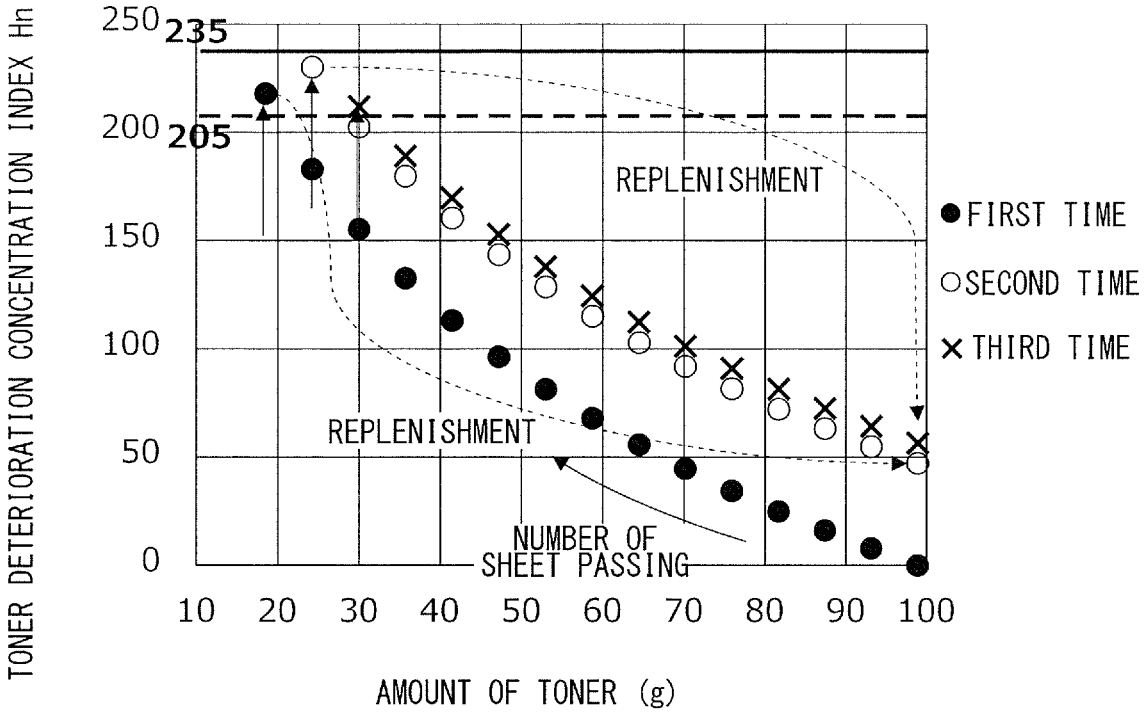
FIGS. 10A and 10B are diagrams illustrating transition of the toner deterioration concentration index in the endurance test performed for the first exemplary embodiment.
Figure 10B:
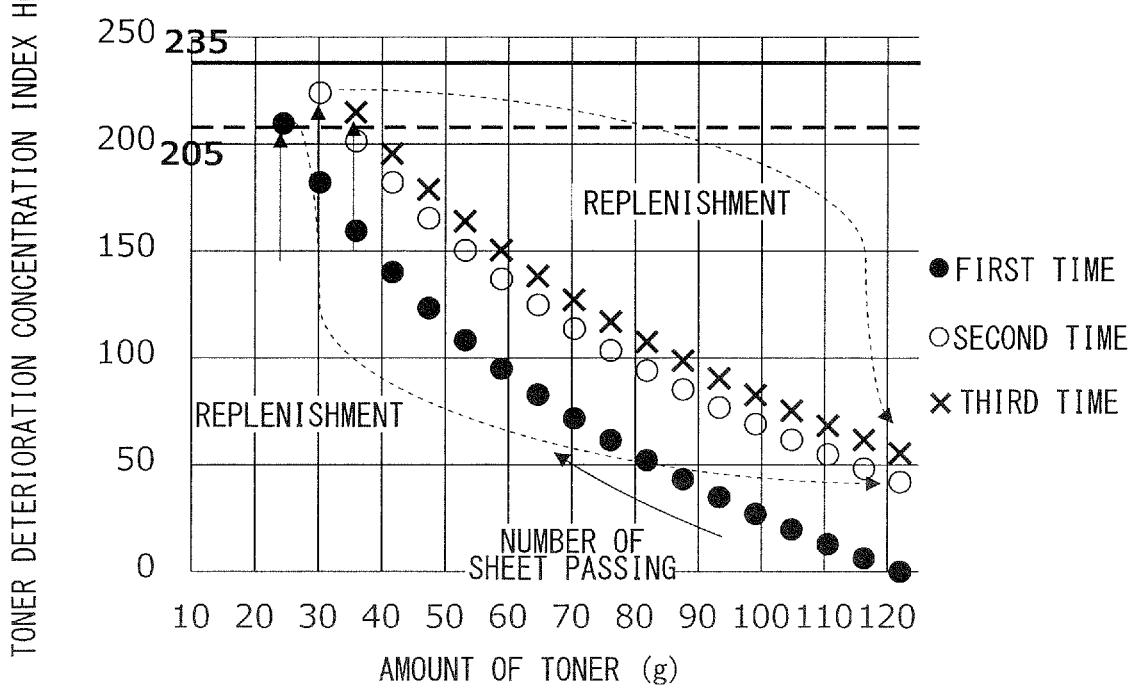
Figure 11A:
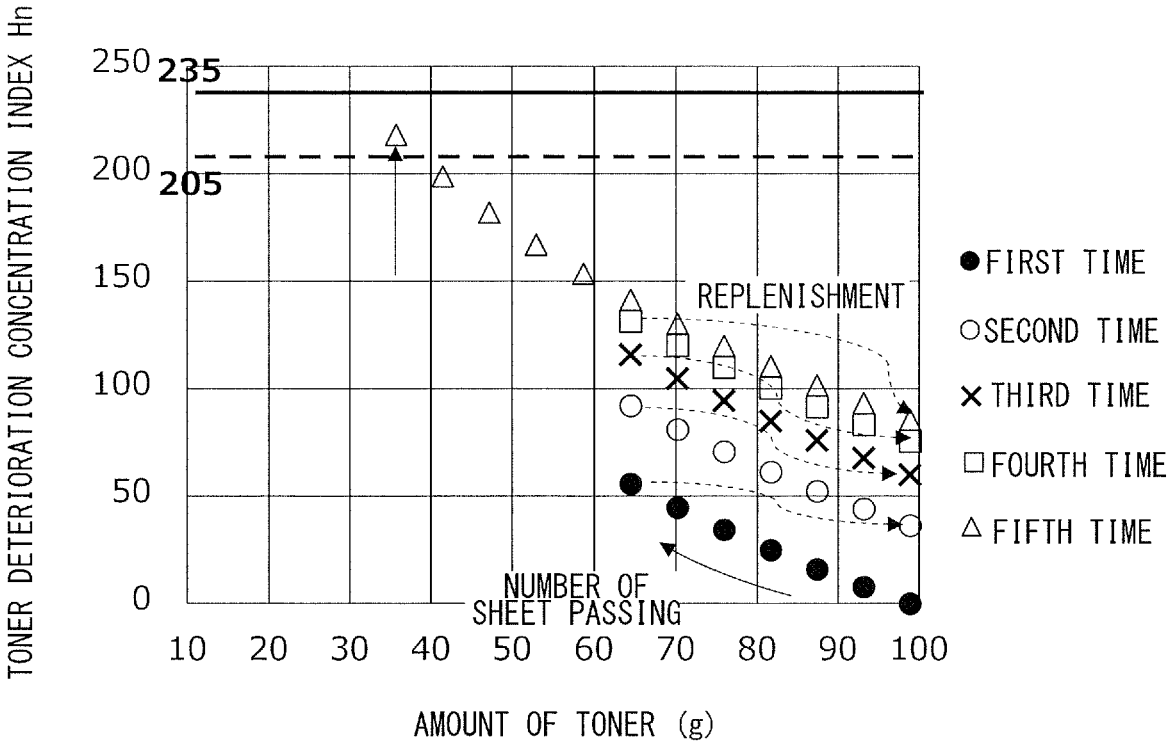
FIGS. 11A and 11B are diagrams illustrating transition of the toner deterioration concentration index in the endurance test performed for the first exemplary embodiment.
Figure 11B:
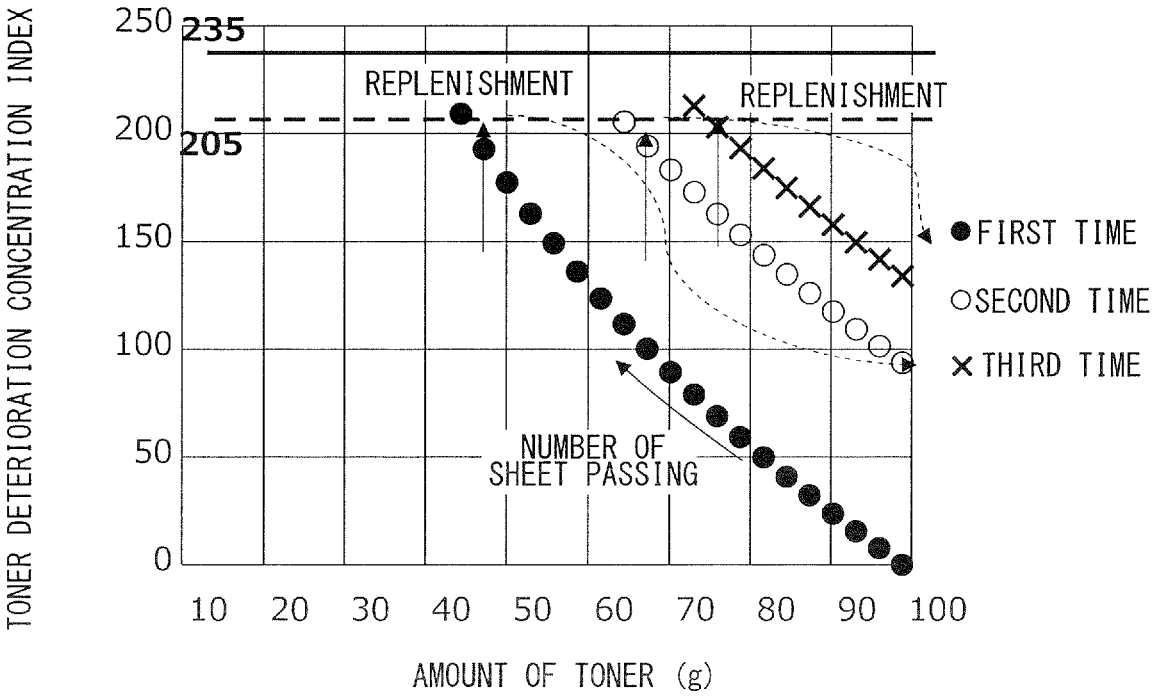

FIGS. 10A to 11B show results of calculation of the toner deterioration concentration index $H_n$. FIG. 10A corresponds to Condition 1, FIG. 10B corresponds to Condition 2, FIG. 11A corresponds to Condition 3, and FIG. 11B corresponds to Condition 4. It can be seen that, in the present example, the toner deterioration concentration index $H_n$ did not exceed 235, which was a value with which background fogging could occur, in any condition because toner replenishment notification was performed when the toner deterioration concentration index $H_n$ became equal to or larger than the threshold value 205, which is indicated by broken lines in the drawings.

To be noted, although the image forming apparatus was operated in the four conditions in the present endurance test, the image coverage in each passing operation normally differs in the actual use condition of image forming apparatus. In addition, it can be also considered that the user performs toner replenishment before the toner replenishment notification is issued or the amount of replenished toner varies each time. Therefore, the degree of deterioration of toner in the developing container takes a transition path different from that of any of the exemplified conditions. However, even in such a situation, occurrence of background fogging derived from toner deterioration can be reduced by monitoring the degree of deterioration of toner in the developing container in average by using the toner deterioration concentration index $H_n$ like the present exemplary embodiment.

In addition, although the toner deterioration concentration index $H_n$ is updated each time the accumulated number of passed-through sheets increases by 1000 in the present exemplary embodiment, the calculation frequency of the index can be changed in accordance with the specification of the product. In this case, if the calculation frequency of the index is set too low, there is a possibility that background fogging problematic for practical use occurs before the next index is calculated, for example, in the case where the previous value of the index is just slightly smaller than the threshold value. However, if the threshold value of the toner deterioration concentration index $H_n$ for performing toner replenishment notification is set low, the possibility of occurrence of background fogging can be reduced even in the case where the calculation frequency is set low. Therefore, the speed of increase of the toner deterioration concentration index $H_n$ may be estimated in advance in accordance with the production specification, and the calculation frequency of the index and the threshold value of the index for preforming toner replenishment notification may be set such that the index does not exceed the upper limit, for example, 235, below which background fogging does not occur, in a period in which the index is not updated.

In addition, although the toner deterioration concentration index $H_n$ is defined by the formulae (1) and (2) described above, a different index may be used as long as the index indicates the degree of deterioration of toner in the developing container in average. The following two are conditions for an index to indicate the degree of deterioration of toner in the developing container in average.

(1) The index increases in accordance with the rotation of the developing roller, and the amount of increase of the index per predetermined amount of rotation of the developing roller is larger in the case where the amount of developer in the developing container is smaller.

(2) The index decreases when the developing container is replenished with developer, and the amount of decrease of the index when the developing container is replenished with developer is larger in the case where the amount of replenished developer is larger.

In addition, in the present exemplary embodiment, the timing for performing toner replenishment notification is determined mainly on the basis of the toner deterioration concentration index $H_n$ regardless of the toner remaining amount in the developing container. As a result of this, the frequency for performing the toner replenishment notification, that is, the frequency in which the user is requested for toner replenishment can be lowered as much as possible. However, for example, as long as the toner deterioration concentration index $H_n$ is managed so as not to exceed a predetermined upper limit, for example, 235, the toner remaining amount at which the toner replenishment notification is performed may be set to be constant. In this case, the minimum image coverage, that is, the lower limit value of a range of assumed average image coverage, for the image forming apparatus is set in advance in consideration of a case where the deterioration of toner progresses faster than the toner consumption speed. Further, the toner deterioration concentration index may be configured not to exceed a predetermined upper limit even in the case where the sheet passing operation is repeated at the minimum image coverage and toner is replenished at an arbitrary timing and by an arbitrary amount of replenishment.

Second Exemplary Embodiment

Next, an image forming apparatus according to a second exemplary embodiment will be described. The present exemplary embodiment is different from the first exemplary embodiment in that the background fogging is further reduced by changing the image formation condition in accordance with the value of the toner deterioration concentration index $H_n$. The mechanical configuration of the image forming apparatus, the calculation method for the toner deterioration concentration index $H_n$, and the like are the same as in the first exemplary embodiment. In the description below, elements having the same configuration and effect as in the first exemplary embodiment will be denoted by the same reference signs as in the first exemplary embodiment, and the description thereof will be omitted.

In the present exemplary embodiment, the potential difference between the potential of the unexposed portion of the photosensitive drum 1, that is, dark potential which is a target potential of a charging step performed by the charging roller 2, and the developing voltage applied to the developing roller 31 is described as an example of an image formation condition changed in accordance with the toner deterioration concentration index $H_n$. This potential difference has a function of biasing the toner having charges of the normal charging polarity not to be attached to the unexposed portion on the surface of the photosensitive drum 1. In the description below, the potential difference between the potential of the unexposed portion of the photosensitive drum 1 and the developing voltage will be referred to as background contrast.

To address the background fogging that degrades the image quality, it is important to grasp the electrical characteristics of the toner particles constituting the background fogging. These toner particles will be hereinafter referred to as fogging toner. For example, in the case where the fogging toner is charged to a polarity opposite to the normal charging polarity, the background fogging can be reduced by reducing the background contrast. Conversely, in the case where the fogging toner is charged to the same polarity as the normal charging polarity, the background fogging can be reduced by increasing the background contrast.

In the present exemplary embodiment, the potential of the unexposed portion at the start of use of the image forming apparatus is set to 880 V, and the developing voltage is set to 380 V Therefore, the background contrast is 500 V in a state in which the number of passed-through sheets accumulated since the start of use of the image forming apparatus is 0.

The toner used in the present exemplary embodiment has a tendency that the toner becomes less likely to be charged to a negative polarity, which is the normal charging polarity, when the deterioration progresses, and the background fogging becomes more likely to occur as a result of increase in the ratio of toner particles charged to an opposite polarity, that is, a positive polarity. Therefore, in the present exemplary embodiment, the background fogging can be reduced by reducing the background contrast when the deterioration of the toner has progressed.

Specifically, in the present exemplary embodiment, in the case where the toner deterioration concentration index $H_n$ has exceeded 205, the potential of the unexposed portion is set to 680 V and thus the background contrast is changed to 300 V to suppress background fogging. Then, the toner replenishment notification is performed when the toner deterioration concentration index $H_n$ becomes equal to or larger than 215, which is a threshold value for notification of the replenishment information to the user in the present exemplary embodiment. To be noted, it has been found that background fogging problematic for practical use also occurs when the toner deterioration concentration index $H_n$ exceeds 250, even in the case where the background contrast is changed to 300 V.

The control method for the image forming apparatus of the present exemplary embodiment is basically the same as in the first exemplary embodiment, and therefore the description thereof will be omitted. However, the threshold value in step S13 of the flowchart of FIG. 7 is changed from 205 to 215. In addition, a process of "changing the potential of the unexposed portion from 880 V to 680 V when the toner deterioration concentration index $H_n$ becomes equal to or larger than 205 for the first time after the previous toner replenishment" is inserted after step S12. In addition, a process of "changing the potential of the unexposed portion back from 680 V to 880 V" is performed after confirming that toner replenishment has been performed, for example, after step S21.

Evaluation Test for Image Quality

To evaluate whether occurrence of background fogging can be actually suppressed by the configuration of the present exemplary embodiment, an endurance test was performed as follows. An image forming apparatus to which the configuration of the present exemplary embodiment was applied was caused to repetitively perform the sheet passing operation, and whether or not background fogging occurred was evaluated. As a recording material, Xerox Vitality Multipurpose Paper (Letter size, 20 lb) was used.

As a reference example, an image forming apparatus that always performs toner replenishment notification when the toner remaining amount in the developing container becomes smaller than a certain threshold value, which is 30 g in this case, was prepared. In contrast, in the present exemplary embodiment, when the toner deterioration concentration index $H_n$ exceeds 205, the potential of the unexposed portion is changed to 680 V and thus the background contrast is changed to 300 V to suppress background fogging. Then, when the toner deterioration concentration index $H_n$ becomes equal to or larger than 215, toner replenishment notification is performed. In addition, for comparison with the first exemplary embodiment, an endurance test was also conducted for the image forming apparatus of the first exemplary embodiment that performs toner replenishment notification when the toner deterioration concentration index $H_n$ exceeds 205, without changing the background contrast from 500 V The toner deterioration concentration index $H_n$ was calculated each time the sheet passing operation was performed 1000 times. The toner remaining amount was based on the detection result of the toner remaining amount sensor 54. In addition, in all of the reference examples, the first exemplary embodiment, and the present exemplary embodiment, about 5.7 g of toner was consumed when an image of image coverage of 2% was formed on 1000 sheets of the recording material, and about 2.9 g of toner was consumed when an image of image coverage of 1% was formed on 1000 sheets of the recording material.

The endurance test was conducted in the following three conditions.

Condition 5: The sheet passing operation was performed at an image coverage of 2% until toner replenishment notification was performed after toner was replenished such that the toner remaining amount became 99 g. This was repetitively performed three times.

Condition 6: The sheet passing operation was performed at an image coverage of 2% until toner replenishment notification was performed after toner was replenished such that the toner remaining amount became 122 g. This was repetitively performed three times.

Condition 7: The sheet passing operation was performed at an image coverage of 1% until toner replenishment notification was performed after toner was replenished such that the toner remaining amount became 99 g. This was repetitively performed three times.

Figures 12A, 12B:
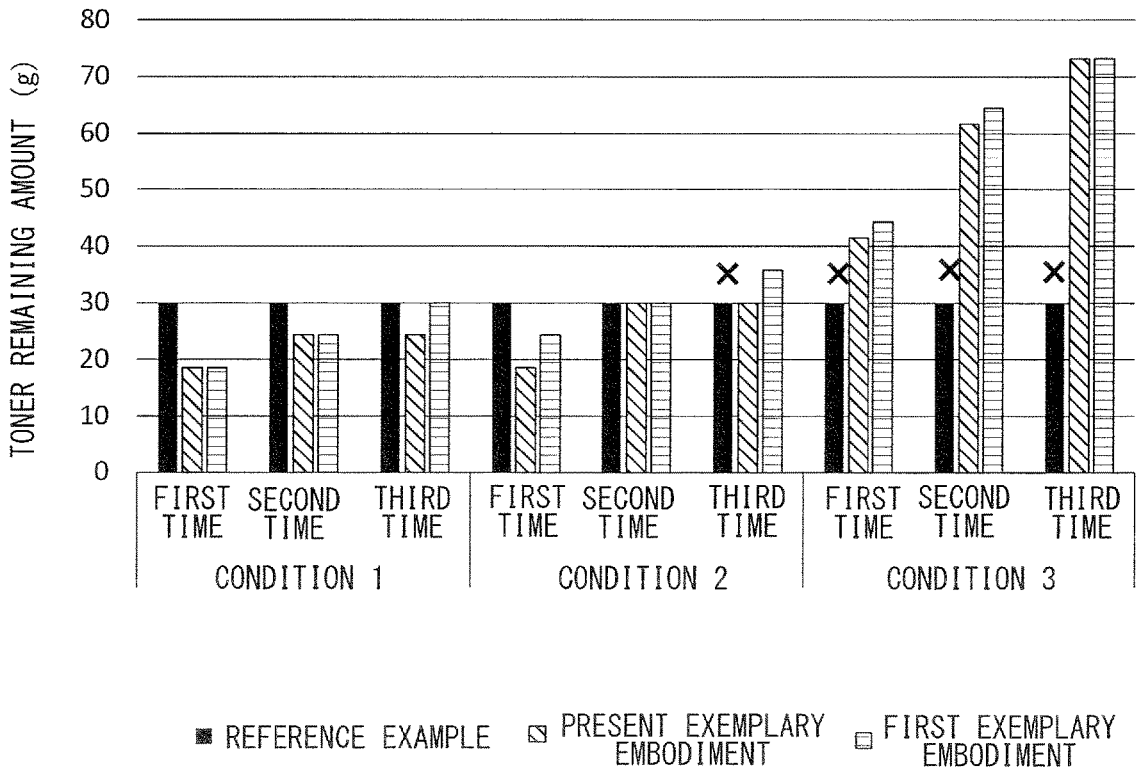
FIGS. 12A and 12B are diagrams showing results of an endurance test performed for a second exemplary embodiment.

The results of the evaluation are shown in FIG. 12A, and the toner remaining amount when toner replenishment notification was performed is shown in FIG. 12B. FIG. 12A shows results of evaluating images output during the test. "Good" corresponds to images non-problematic for practical use, and "Bad" (cross mark in FIG. 12B) corresponds to occurrence of background fogging problematic for practical use.

In the reference example, no problem occurred in Condition 5, but background fogging problematic for practical use occurred in Condition 6 in which the amount of replenished toner was larger than in Condition 5, and in Condition 7 in which the image coverage was lower than in Condition 5. In contrast, in the first exemplary embodiment and the present exemplary embodiment, it was confirmed that occurrence of background fogging derived from toner deterioration was reduced.

In addition, comparing the first exemplary embodiment with the present exemplary embodiment in FIG. 12B, the toner remaining amount at the time when the toner replenishment notification was performed was smaller in the present exemplary embodiment. This is because, in the present exemplary embodiment, the sheet passing operation is continued by changing the background contrast even in a state in which the toner deterioration concentration index $H_n$ has exceeded the threshold value of the first exemplary embodiment, which is 205 in this case, and then toner replenishment notification is performed when the value of the index becomes equal to or larger than a threshold value, which is larger than that of the first exemplary embodiment and is 215 in this case. That is, in the present exemplary embodiment, by adjusting the background contrast serving as an example of image formation condition, the sheet passing operation can be continued while suppressing background fogging to a degree similar to that of the first exemplary embodiment until the toner remaining amount in the developing container reaches a smaller value.

Figure 13A:
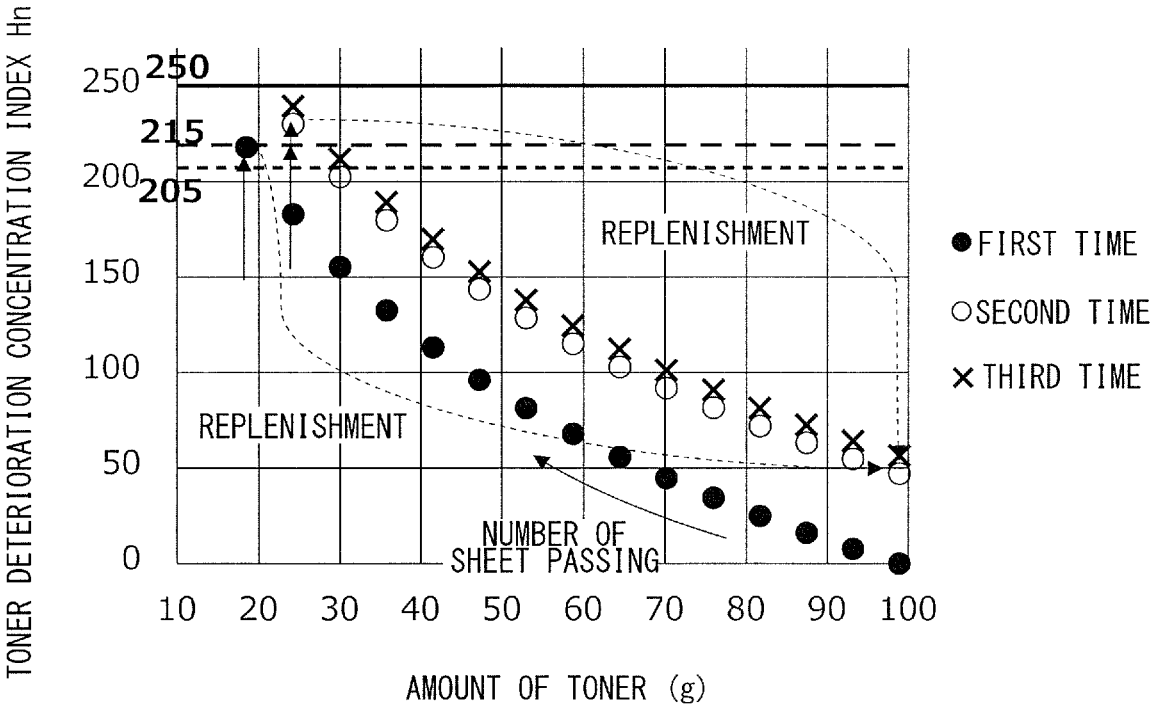
FIGS. 13A and 13B are diagrams illustrating transition of the toner deterioration concentration index in the endurance test performed for the second exemplary embodiment.
Figure 13B:
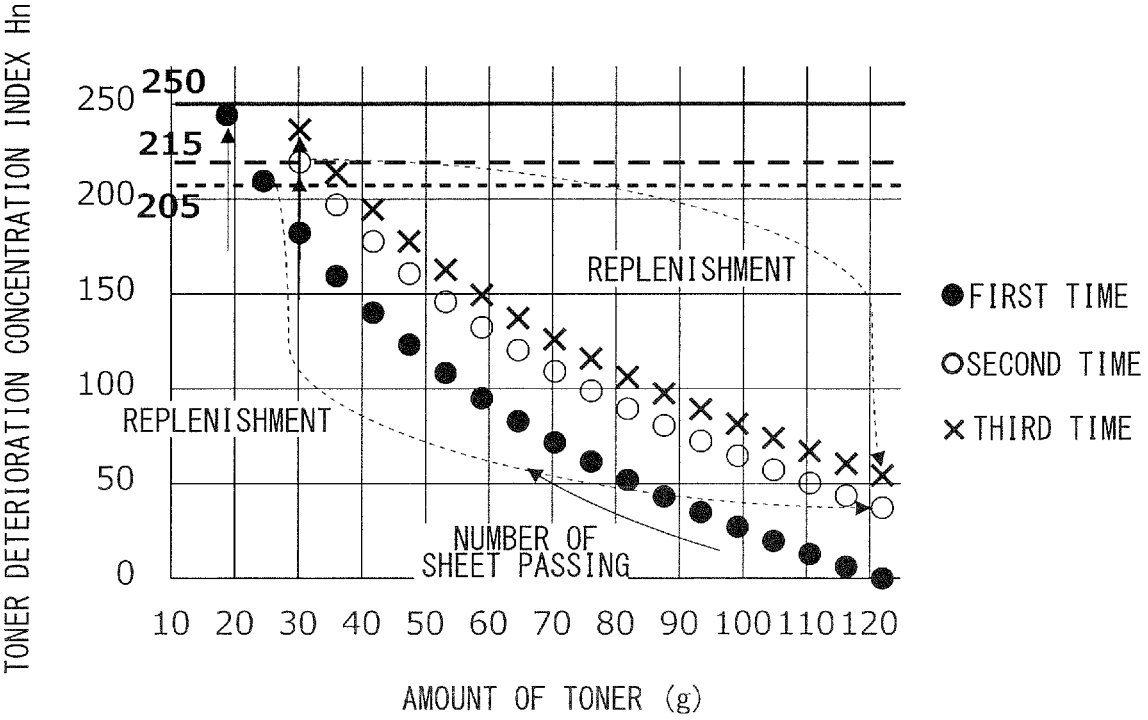
Figure 14:
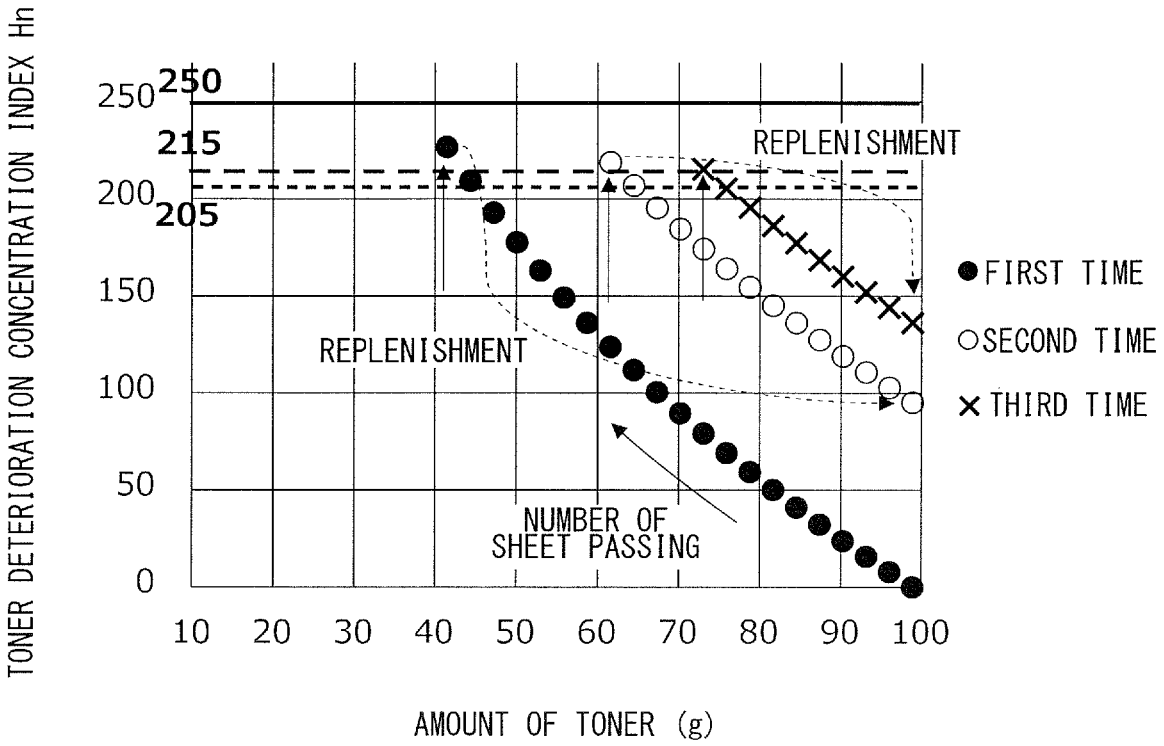
FIG. 14 is a diagram illustrating transition of the toner deterioration concentration index in the endurance test performed for the second exemplary embodiment.

FIGS. 13A to 14 show results of calculation of the toner deterioration concentration index $H_n$. FIG. 13A corresponds to Condition 5, FIG. 13B corresponds to Condition 6, and FIG. 14 corresponds to Condition 7. To be noted, since Conditions 5, 6, and 7 are respectively the same as Conditions 1, 2, and 4 of the first exemplary embodiment, graphs indicating cases where the toner deterioration concentration index $H_n$ of the image forming apparatus of the first exemplary embodiment is calculated for Conditions 5, 6, and 7 are respectively the same as FIGS. 10A, 10B, and 11B.

As illustrated in FIG. 13A to FIG. 14, in the present exemplary embodiment, the sheet passing operation is continued even after the toner deterioration concentration index $H_n$ has exceeded 205, and then the toner replenishment notification is performed when the toner deterioration concentration index $H_n$ becomes equal to or larger than the threshold value 215, which is indicated by broken lines in the drawings. As a result of this, it can be seen that the toner deterioration concentration index $H_n$ does not exceed 250, which is the value at which background fogging can occur even in the case where the background contrast is adjusted.

Modification Example

To be noted, in the present exemplary embodiment, the value of the background contrast, particularly the potential of the unexposed portion has been described as an example of an image formation condition changed for reducing background fogging derived from toner deterioration. This is not limiting, and for example, a voltage having the same polarity as the normal charging polarity of toner may be applied to the developing blade 39. In this case, charge is supplied from the developing blade 39 to toner due to the applied voltage when the developing blade 39 frictionally charges the toner, and therefore the amount of charge of the toner born on the developing roller 31 can be increased.

In addition, in the present exemplary embodiment, reducing background fogging derived from decrease in the amount of charge of toner has been described as an example of an image defect caused by toner deterioration. However, the image formation condition may be changed to suppress a different image defect caused by toner deterioration. Examples of the different image defect include decrease in the transfer efficiency in the transfer portion and contamination of the charging roller 2 caused by attachment of deteriorated toner to the charging roller 2. For example, in the case of suppressing decrease in the transfer efficiency, reducing the amount of toner born on the photosensitive drum 1 by reducing the developing voltage or increasing the transfer voltage can be considered. In addition, in the case of suppressing contamination of the charging roller 2, increasing the number of cleaning operations of the charging roller 2 can be considered. To be noted, the cleaning operation of the charging roller 2 refers to, for example, rotating the photosensitive drum 1 and the charging roller 2 while applying a voltage having a polarity opposite to the normal charging polarity of the toner and thus transferring toner attached to the charging roller 2 to the photosensitive drum 1 to remove the toner. The toner having transferred to the photosensitive drum 1 is then collected into the developing container by the developing roller 31.

As described above, according to the technique of the present disclosure, occurrence of image defects caused by toner deterioration can be suppressed.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-049203, filed on Mar. 15, 2019, which is hereby incorporated by reference herein in its entirety.

What is claimed is:

1. An image forming apparatus configured to form an image on a recording material, the image forming apparatus comprising:

a rotatable image bearing member configured to bear an electrostatic latent image;

a developing container configured to accommodate developer comprising toner;

a developer bearing member configured to rotate while bearing the developer accommodated in the developing container and develop the electrostatic latent image born on the image bearing member into a toner image;

a transfer member configured to transfer the toner image born on the image bearing member onto the recording material; and a notification portion configured to notify replenishment information for prompting replenishing the developing container with the developer in a case where an index is equal to or larger than a preset threshold value, wherein the index is set such that the index increases in accordance with rotation of the developer bearing member and decreases in accordance with replenishment of the developing container with the developer, wherein an amount of increase of the index per predetermined amount of rotation of the developer bearing member is larger in a case where an amount of the developer in the developing container is smaller, and wherein an amount of decrease of the index according to the replenishment of the developing container with the developer is larger in a case where an amount of replenished developer is larger.

2. The image forming apparatus according to claim 1, wherein the amount of increase of the index per the predetermined amount of rotation of the developer bearing member is inversely proportional to the amount of the developer in the developing container, and wherein in a case where the developing container is replenished with the developer, the index decreases in accordance with a ratio of the amount of the developer in the developing container before the replenishment to the amount of the developer in the developing container after the replenishment.

3. The image forming apparatus according to claim 1, wherein a potential difference between a potential of a region in a surface of the image bearing member where the electrostatic latent image is not formed and a voltage applied to the developer bearing member is changed in accordance with a value of the index.

4. The image forming apparatus according to claim 1, further comprising a regulation member that is disposed in an opening portion of the developing container where the developer bearing member is disposed and that is configured to regulate the amount of the developer born on the developer bearing member, wherein a value of a voltage applied to the regulation member is changed in accordance with a value of the index.

5. The image forming apparatus according to claim 1, wherein a value of a voltage applied to the transfer member is changed in accordance with a value of the index.

6. The image forming apparatus according to claim 1, further comprising a charging member configured to abut the image bearing member and charge a surface of the image bearing member, wherein the image forming apparatus is configured to perform a cleaning operation of removing the toner attached to the charging member, and wherein frequency of the cleaning operation is changed in accordance with a value of the index.

7. The image forming apparatus according to claim 1, further comprising a detection portion configured to detect the amount of the developer in the developing container, wherein the index is calculated on a basis of a detection result of the detection portion.

8. The image forming apparatus according to claim 1, wherein the developer bearing member is configured to collect, into the developing container, toner that is not transferred onto the recording material by the transfer member after being supplied to the image bearing member from the developer bearing member in a developing region where the image bearing member and the developer bearing member face each other and that is not used for development of the electrostatic latent image when reaching the developing region again by rotation of the image bearing member.

9. The image forming apparatus according to claim 1, further comprising:

an agitation member configured to agitate the developer in the developing container; and a drive source configured to drive the developer bearing member and the agitation member.

10. The image forming apparatus according to claim 1, further comprising a display apparatus configured to display information as an image, wherein the notification portion notifies the replenishment information via the display apparatus.

11. The image forming apparatus according to claim 1, wherein the notification portion notifies the replenishment information via a display apparatus provided in an external apparatus by communicating with the external apparatus.

12. An image forming apparatus configured to form an image on a recording material, the image forming apparatus comprising:

a rotatable image bearing member configured to bear an electrostatic latent image;

a developing container configured to accommodate developer comprising toner;

a developer bearing member configured to rotate while bearing the developer accommodated in the developing container and develop the electrostatic latent image born on the image bearing member into a toner image;

a transfer member configured to transfer the toner image born on the image bearing member onto the recording material; and a notification portion configured to notify replenishment information for prompting replenishing the developing container with the developer, wherein the notification portion notifies the replenishment information if an amount of the developer in the developing container has decreased to a first value in a case of repetitively performing image formation on the recording material after the developing container is replenished with a first amount of the developer in a state in which a predetermined amount of the developer is accommodated in the developing container, and wherein the notification portion notifies the replenishment information if the amount of the developer in the developing container has decreased to a second value smaller than the first value in a case of repetitively performing image formation on the recording material after the developing container is replenished with a second amount of the developer in a state in which the predetermined amount of the developer is accommodated in the developing container, the second value being smaller than the first value.

13. The image forming apparatus according to claim 12, wherein the developer bearing member is configured to collect, into the developing container, toner that is not transferred onto the recording material by the transfer member after being supplied to the image bearing member from the developer bearing member in a developing region where the image bearing member and the developer bearing member face each other and that is not used for development of the electrostatic latent image when reaching the developing region again by rotation of the image bearing member.

14. The image forming apparatus according to claim 12, further comprising:

an agitation member configured to agitate the developer in the developing container; and a drive source configured to drive the developer bearing member and the agitation member.

15. The image forming apparatus according to claim 12, further comprising a display apparatus configured to display information as an image, wherein the notification portion notifies the replenishment information via the display apparatus.

16. The image forming apparatus according to claim 12, wherein the notification portion notifies the replenishment information via a display apparatus provided in an external apparatus by communicating with the external apparatus.

* * * * *